US012378861B2

(12) United States Patent
Christie et al.

(10) Patent No.: US 12,378,861 B2
(45) **Date of Patent: *Aug. 5, 2025**

(54) COORDINATED PUMPING OPERATIONS

(71) Applicant: Schlumberger Technology Corporation, Sugar Land, TX (US)

(72) Inventors: Richard Christie, Sugar Land, TX (US); Florence Binet, Antony (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/623,686

(22) Filed: Apr. 1, 2024

(65) Prior Publication Data

US 2024/0263551 A1 Aug. 8, 2024

Related U.S. Application Data

(63) Continuation of application No. 17/808,787, filed on Jun. 24, 2022, now Pat. No. 11,946,352, which is a (Continued)

(51) Int. Cl.
*E21B 43/26* (2006.01)

(52) U.S. Cl.
CPC ..... *E21B 43/26* (2013.01); *E21B 43/2607* (2020.05)

(58) Field of Classification Search
CPC ..... E21B 43/26; E21B 43/2607
See application file for complete search history.

(56) References Cited

U.S. PATENT DOCUMENTS 5,573,225 A 11/1996 Boyle
7,451,819 B2 11/2008 Chang
(Continued)

FOREIGN PATENT DOCUMENTS

WO 2019222033 11/2019

OTHER PUBLICATIONS

Fox, M., and Long, D. 2003. PDDL2.1: An extension to PDDL for expressing temporal planning domains. J. Artif. Int. Res. 20(1):61{124.
(Continued)

*Primary Examiner* — James G Sayre
(74) *Attorney, Agent, or Firm* — Michael L. Flynn

(57) ABSTRACT

Systems and methods presented herein enable coordinated pumping operations. An example system may include a treatment fluid system configured to pump a treatment fluid into a wellbore, a pump-down system configured to pump a pump-down fluid into the wellbore to convey a perforating tool, a fluid valve system configured to selectively fluidly connect and disconnect the treatment fluid system and the pump-down system to and from the wellbore, and a controller communicatively connected to the treatment fluid system, the pump-down system, and the fluid valve system. The controller may be configured to monitor operational status of the treatment fluid system, the pump-down system, and the fluid valve system, and control operations of the treatment fluid system, the pump-down system, and the fluid valve system based at least in part on the operational status of the treatment fluid system, the pump-down system, and the fluid valve system.

20 Claims, 6 Drawing Sheets

Related U.S. Application Data continuation of application No. 16/937,681, filed on Jul. 24, 2020, now Pat. No. 11,371,330.

(60) Provisional application No. 62/877,994, filed on Jul. 24, 2019.

(56) References Cited

U.S. PATENT DOCUMENTS

| | | | | |
|---|---|---|---|---|
| 7,665,535 | B2 | 2/2010 | Van Wulfften Palthe | |
| 8,726,983 | B2 | 5/2014 | Khan | |
| 8,775,347 | B2 | 7/2014 | Goel | |
| 9,097,084 | B2 | 8/2015 | McDougall | |
| 9,109,415 | B2 | 8/2015 | Coles | |
| 9,617,814 | B2 | 4/2017 | Seals | |
| 9,657,540 | B2 | 5/2017 | Coles | |
| 10,309,176 | B2 | 6/2019 | Allmaras | |
| 11,371,330 | B2 | 6/2022 | Christie | |
| 11,946,352 | B2 * | 4/2024 | Christie | E21B 43/2607 |
| 2002/0062156 | A1 | 5/2002 | Yamakawa | |
| 2004/0088115 | A1 | 5/2004 | Guggari | |
| 2005/0209836 | A1 | 9/2005 | Klumpen | |
| 2005/0209912 | A1 | 9/2005 | Veeningen | |
| 2008/0231467 | A1 | 9/2008 | Jeffryes | |
| 2008/0275594 | A1 | 11/2008 | De Guzman | |
| 2008/0281525 | A1 | 11/2008 | Boone | |
| 2008/0306803 | A1 | 12/2008 | Vaal | |
| 2009/0132458 | A1 | 5/2009 | Edwards | |
| 2009/0276156 | A1 | 11/2009 | Kragas | |
| 2012/0054246 | A1 | 3/2012 | Fischer | |
| 2013/0138254 | A1 | 5/2013 | Seals | |
| 2013/0231787 | A1 | 9/2013 | Chapman | |
| 2014/0208253 | A1 | 7/2014 | Pettus | |
| 2014/0214469 | A1 | 7/2014 | Callow | |
| 2014/0246238 | A1 | 9/2014 | Abbassian | |
| 2015/0167414 | A1 | 6/2015 | Coles | |
| 2015/0330172 | A1 | 11/2015 | Allmaras | |
| 2016/0115773 | A1 | 4/2016 | Conrad | |
| 2017/0030178 | A1 * | 2/2017 | Oehring | E21B 23/08 |
| 2017/0241221 | A1 | 8/2017 | Seshadri | |
| 2017/0314353 | A1 | 11/2017 | Viassolo | |
| 2017/0370191 | A1 | 12/2017 | Fox | |
| 2018/0012310 | A1 | 1/2018 | Fox | |
| 2019/0316447 | A1 * | 10/2019 | Oehring | E21B 43/2607 |
| 2019/0354911 | A1 * | 11/2019 | Alaniz | G06Q 10/06316 |
| 2020/0175444 | A1 | 6/2020 | Fox | |
| 2020/0224508 | A1 | 7/2020 | Chapman | |
| 2020/0270979 | A1 | 8/2020 | Hradecky | |
| 2021/0025267 | A1 | 1/2021 | Christie | |

OTHER PUBLICATIONS

Firby, Adaptive Execution in Complex Dynamic Worlds. Ph.D. Thesis, Yale University Department of Computer Science, 1989.

Simmons et al., "A Task Description Language for Robot Control", Proceedings of the Conference on Intelligent Robotics and Systems, Vancouver, Canada, Oct. 1998, pp. 1931-1937.

Gat, E., "ESL: A Language for Supporting Robust Plan Execution in Embedded Autonomous Agents", Proceedings of the AAAI Fall Symposium on Plan Execution, 1996, pp. 319-324.

Berry, G., The esterel v5 Language Primer, version 5.21 release 2.0, Centre de Mathematiques Appliquees, Ecole des Mines and INRIA, Apr. 6, 1999, 140 pgs.

Ingham et al., 2001: A Reactive Model-Based Programming Language for Robotic Space Explorers, Proceedings of ISAIRAS-01, 8 pages.

Nieuwenhuis, "SAT modulo theories: Enhancing SAT with special-purpose algorithms", in Proc. 12th International Conference on Theory and Applications of Satisfiability Testing (SAT), p. 1, 2009.

Berry et al., "The ESTEREL synchronous programming language: design, semantics, implementation", Science of Computer Programming, 19(2): 87-152, 1992.

Coles et al., "Forward-chaining partial-order planning", In Proceedings of the 20th International Conference on Automated Planning and Scheduling, ICAPS 2010, Toronto, Ontario, Canada, May 12-16, 2010, pp. 42-49, 2010.

Williams et al., "Model-based Programming of Intelligent Embedded Systems and Robotic Space Explorers", Proceedings of the IEEE, 91(1): 212-237, 2003.

Yoon et al., "FF-Replan: A Baseline for Probabilistic Planning", in Proc. 17th International Conference on Automated Planning and Scheduling (ICAPS), 2007, 8 pages.

Henzinger, "The Theory of Hybrid Automata", in Proceedings, 11th Annual IEEE Symposium on Logic in Computer Science, pp. 278-292, 1996.

Lamport, "Time, clocks, and the ordering of events in a distributed system", Communications of the ACM, 21(7): 558-565, 1978.

Williams et al., "Model-based programming: Controlling embedded systems by reasoning about hidden state", in Principles and Practice of Constrant Programming—CP 2002, 8th International Conference, CP 2002, Ithaca, NY, USA, Sep. 9-13, 2002, Proceedings, pp. 508-524, 2002.

Apt et al., "Towards a theory of declarative knowledge", in Foundations of Deductive Databases and Logic Programming, pp. 89-148, 1988.

Bacchus et al., "Downward Refinement and the Efficiency of Hierarchical Problems-Solving", Artificial Intelligence, vol. 71, pp. 43-100, 1994.

Bernardini et al., "Leveraging Probabilistic Reasoning in Deterministic Planning for Large-Scale Autonomous Search-and-Tracking", in Proc. 26th International Conference on Automated Planning and Scheduling (ICAPS), pp. 47-55, 2016.

Bonasso et al., "Experiences with an Architecture for Intelligent Reactive Agent", Journal of Experimental and Theoretical Artificial Intelligence (JETAI), 9, 1997, 24 pages.

Coddington et al., "Madbot: A motivated and goal directed robot", in Proc. of National conference on AI (AAAI), vol. 20, pp. 1680, 2005.

Fox et al., "Exploration of the Robustness of Plans", in Proc. 21st National Conference on Artificial Intelligence (AAAI), pp. 834-839, 2006.

Gat, "On Three-Layer Architecutes", Artificial Intelligence and Mobile Robots, 195, 11 pages, 1998.

Gregory et la., "Planning Modulo Theories: Extending the Planning Paradigm", in Proc. 22nd International Conference on Automated Planning and Scheduling (ICAPS), 2012, 9 pages.

Hoffmann et al., "The FF Planning Systems: Fast Plan Generation Through Heuristic Search", J. Artif. Intell. Res. (JAIR), 14:253-302, 2001.

Howey et al., "VAL: automatic plan validation, continuous effects and mixed initiative planning using PDDL", in Proc. 16th IEEE International Conference on Tools with Artificial Intelligence (ICTAI), pp. 294-301, 2004.

Koymans et al., "Specifying Real-Time Properties with Metric Temporal Logic", Real-Time Systems, 2(4): 255-299, 1990.

McGann et la., "A Deliberative architecture for AUV Control", in Proc. IEEE International Conference on Robotics and Automation (ICRA), pp. 1049-1054, 2008.

* cited by examiner

COORDINATED PUMPING OPERATIONS

CROSS-REFERENCES TO RELATED APPLICATIONS

This application is a continuation of U.S. patent application Ser. No. 16/937,681, entitled "Coordinated Pumping Operations," filed Jul. 24, 2020, which claims priority to and the benefit of U.S. Provisional Patent Application No. 62/877,994, entitled "Coordinated Pumping Operations," filed Jul. 24, 2019, both of which are hereby incorporated by reference in their entireties for all purposes.

BACKGROUND

The present disclosure generally relates to systems and methods for coordinated pumping operations with respect to wellbore stimulation jobs.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as an admission of any kind.

A wellbore stimulation job utilizes several well service systems at a wellsite. A stimulation job for a horizontal wellbore may include dividing the wellbore into numerous individual operations or stages. For example, a wellbore stimulation job may be divided into sixty or more individual stimulation operations or stages. The process utilizes individual pumping and wireline operations (e.g., pump-down and perforating operations) between each stimulation stage (e.g., hydraulic fracturing) to isolate the wellbore and perforate a casing. Such pumping and wireline operations also include wellhead fluid control valves associated with the wellbore.

The above-described operations and systems utilize different well services that are executed independently, each focusing on different objectives without knowledge or consideration of status of other well services. For example, each well service is conducted by corresponding equipment that is manually coordinated by different companies and/or crews, with little to no automation or communication between the well services. Coordination across these well services may include implementing checklists, manual hand signals, and voice communication via radios in order to execute each consecutive well service. A completion job becomes even more challenging as multi-well pads are constructed to permit multiple wellbores to be stimulated in parallel with the same suite of well servicing equipment. Lack of coordination and communication between the well services results in inefficiencies, resulting in fewer (e.g., just 12-16) hours of active pumping per day.

SUMMARY

A summary of certain embodiments described herein is set forth below. It should be understood that these aspects are presented merely to provide the reader with a brief summary of these certain embodiments and that these aspects are not intended to limit the scope of this disclosure.

Certain embodiments of the present disclosure include a system that includes a treatment fluid system configured to pump a treatment fluid into a wellbore extending into a subterranean formation from a surface of an oil and gas wellsite. The system also includes a pump-down system configured to pump a pump-down fluid into the wellbore to convey a perforating tool through the wellbore. The system further includes a fluid valve system configured to selectively fluidly connect and disconnect the treatment fluid system and the pump-down system to and from the wellbore. In addition, the system includes a controller having at least one processor and at least one memory storing executable program code instructions. The controller is communicatively connected to the treatment fluid system, the pump-down system, and the fluid valve system. The program code instructions, when executed by the at least one processor, cause the controller to: monitor operational status of the treatment fluid system, the pump-down system, and the fluid valve system; and control operations of the treatment fluid system, the pump-down system, and the fluid valve system based at least in part on the operational status of the treatment fluid system, the pump-down system, and the fluid valve system.

In addition, certain embodiments of the present disclosure include a method that includes operating a treatment fluid system to pump a treatment fluid into a wellbore extending into a subterranean formation from a surface of an oil and gas wellsite. The method also includes operating a pump-down system to pump a pump-down fluid into the wellbore to convey a perforating tool through the wellbore. The method further includes operating a fluid valve system to selectively fluidly connect and disconnect the treatment fluid system and the pump-down system to and from the wellbore. In addition, the method includes monitoring, using a controller, operational status of the treatment fluid system, the pump-down system, and the fluid valve system. The method also includes controlling, using the controller, operations of the treatment fluid system, the pump-down system, and the fluid valve system based at least in part on the operational status of the treatment fluid system, the pump-down system, and the fluid valve system.

In addition, certain embodiments of the present disclosure include a system that includes a fracturing fluid system having a fracturing fluid mixing and pumping system for facilitating well fracturing operations including pumping a fracturing fluid into a wellbore extending into a subterranean formation from a surface of an oil and gas wellsite. The system also includes a pump-down system having at least one pump and at least one container storing a pump-down fluid. The pump-down system is configured to pump the pump-down fluid into the wellbore to convey a perforating tool downhole through the wellbore when the pump-down system is fluidly connected to the wellbore. The system further includes a fluid valve system configured to selectively fluidly connect and disconnect the fracturing fluid system and the pump-down system to and from the wellbore. The fluid valve system includes a fracturing manifold fluidly connected between the fracturing fluid system and the wellbore. The fracturing manifold is configured to selectively fluidly connect and disconnect the fracturing fluid system to and from the wellbore. In addition, the system includes a controller having at least one processor and at least one memory storing executable program code instructions. The controller is communicatively connected to the fracturing fluid system, the pump-down system, and the fluid valve system. The program code instructions, when executed by the at least one processor, cause the controller to: monitor operational status of the fracturing fluid system, the pump-down system, and the fluid valve system; and operate the fluid valve system to alternatingly connect and disconnect the fracturing fluid system and the pump-down system to and from the wellbore based at least in part on the operational status of the fracturing fluid system, the pump-down system, and the fluid valve system.

Various refinements of the features noted above may be undertaken in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings, in which.

DETAILED DESCRIPTION

Figure 1:
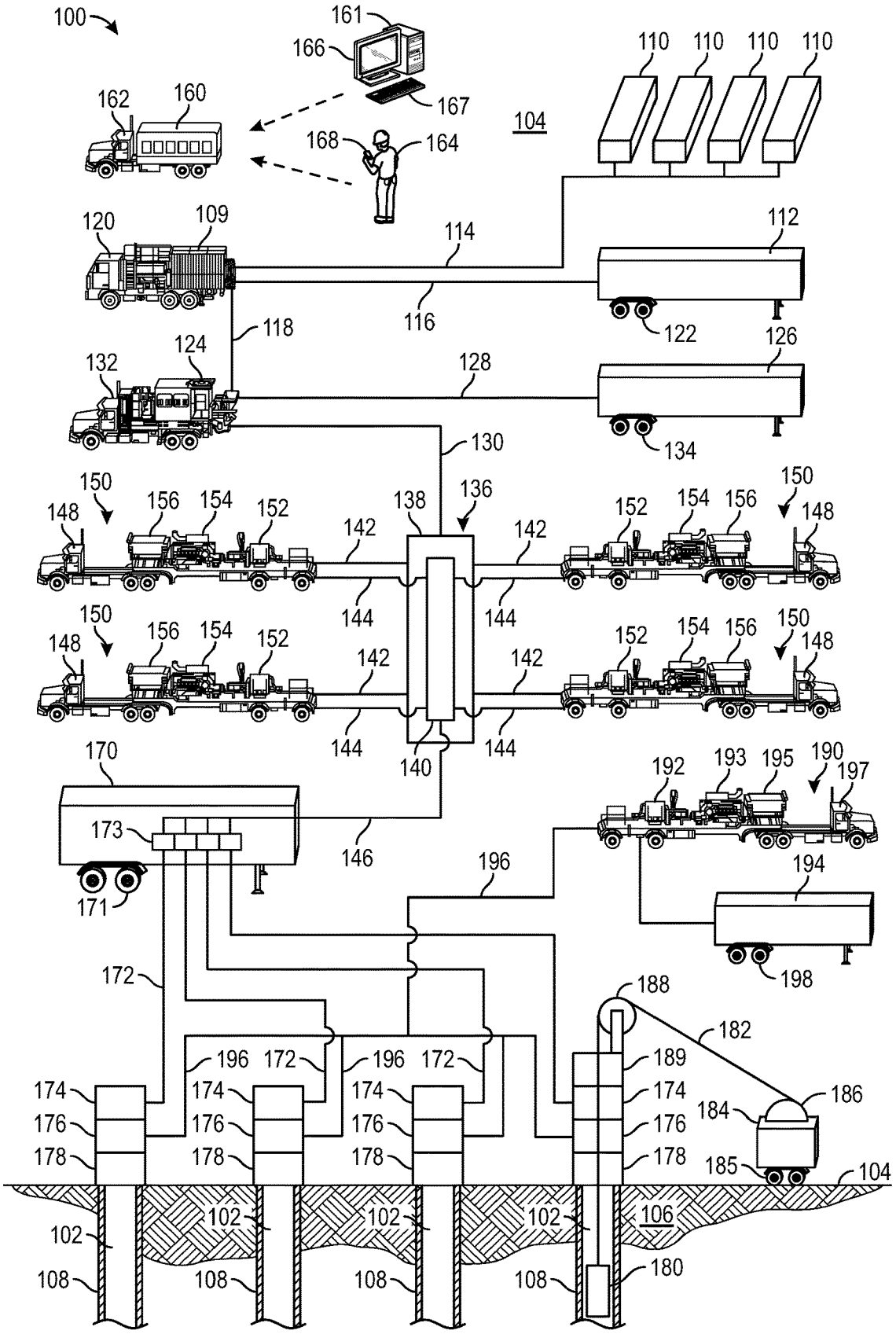
FIG. 1 is a schematic view of at least a portion of an example implementation of a wellsite system, in accordance with embodiments of the present disclosure.

One or more specific embodiments of the present disclosure will be described herein. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

As used herein, the terms "connect," "connection," "connected," "in connection with," and "connecting" are used to mean "in direct connection with" or "in connection with via one or more elements"; and the term "set" is used to mean "one element" or "more than one element." Further, the terms "couple," "coupling," "coupled," "coupled together," and "coupled with" are used to mean "directly coupled together" or "coupled together via one or more elements." As used herein, the terms "up" and "down," "uphole" and "downhole", "upper" and "lower," "top" and "bottom," and other like terms indicating relative positions to a given point or element are utilized to more clearly describe some elements. Commonly, these terms relate to a reference point as the surface from which drilling operations are initiated as being the top (e.g., uphole or upper) point and the total depth along the drilling axis being the lowest (e.g., downhole or lower) point, whether the well (e.g., wellbore, borehole) is vertical, horizontal or slanted relative to the surface.

As used herein, a fracture shall be understood as one or more cracks or surfaces of breakage within rock. Fractures can enhance permeability of rocks greatly by connecting pores together and, for that reason, fractures can be induced mechanically in some reservoirs in order to boost hydrocarbon flow. Certain fractures may also be referred to as natural fractures to distinguish them from fractures induced as part of a reservoir stimulation. Fractures can also be grouped into fracture clusters (or "perf clusters") where the fractures of a given fracture cluster (perf cluster) connect to the wellbore through a single perforated zone. As used herein, the term "fracturing" refers to the process and methods of breaking down a geological formation and creating a fracture (i.e., the rock formation around a wellbore) by pumping fluid at relatively high pressures (e.g., pressure above the determined closure pressure of the formation) in order to increase production rates from a hydrocarbon reservoir.

In addition, as used herein, the terms "real time", "real-time", or "substantially real time" may be used interchangeably and are intended to described operations (e.g., computing operations) that are performed without any human-perceivable interruption between operations. For example, as used herein, data relating to the systems described herein may be collected, transmitted, and/or used in control computations in "substantially real time" such that data readings, data transfers, and/or data processing steps occur once every second, once every 0.1 second, once every 0.01 second, or even more frequent, during operations of the systems (e.g., while the systems are operating). In addition, as used herein, the terms "automatic" and "automated" are intended to describe operations that are performed are caused to be performed, for example, by a process control system (i.e., solely by the process control system, without human intervention).

Exploring, drilling and completing hydrocarbon and other wells are relatively complicated, time consuming and, ultimately, relatively expensive endeavors. As a result, over the years, well depth and architecture have been extended in order to help enhance access to underground hydrocarbon reserves. For example, it is not uncommon to find hydrocarbon wells exceeding 30,000 feet in depth. While such well depths may increase the likelihood of accessing underground hydrocarbon reservoirs, other challenges are presented in terms of well management and the maximization of hydrocarbon recovery from such wells. For example, during completions, the well architecture may be enhanced by a series of wireline-run perforating applications tailored to introduce fractures and perforations into a formation defining the well. Thus, subsequent stimulated recovery from the reservoir may help to maximize overall production.

However, the added depth and increased complexity of the well architecture may present new challenges to running such wireline run applications, for example, by increasing trip time for a wireline run into the well. In addition to increased time spent on the more extensive pump-down-perforating applications, the added depth and time of the application may also translate into other potential issues. For example, accurately locating the perforating guns of the system in the well may be a challenge. Further, as with any pump-down-perforating operations, tension on the wireline from the pump-aided deployment may lead to separation of the guns or other tool components from the wireline. However, where the well depth is increased, the possibility of such separation is increased due to the added potential pressure buildup as well as the increased time spent on deployment of the system.

The embodiments described herein combine the pumping data with downhole data into software that is configured to provide a "master" automated (e.g., without human intervention) control of the pumps and the other equipment of a wellsite system. In certain embodiments, the software is configured to coordinate control of all of the equipment of the wellsite system, which may be followed if the context of the operation is suitable or ignored, if desired, by the wireline or pump operator. As used herein, the terms "automated" and "automation" are intended to mean performance of certain operations without human intervention.

The data acquisition system described herein may include data collected downhole via a wireline system, which provides several data channels that provide time, depth, velocity, casing collar locator (CCL), tension, and fluid pressure, among other data. For example, head tension may be provided by a tool attached to the top of the perforating gun, and may be transmitted via wireline to the surface into the data acquisition system. The data acquisition system also acquires pump data at perhaps about 1 Hz from multiple pumps, and sends commands to control the overall rate of fluid being pumped downhole, among other control commands, as described herein. In addition, the discharge pressure may be provided by the pumps, which may be very close to the pressure being applied to the wellhead and to the downhole tool (e.g., which may be monitored by the downhole tool, as described herein). Variations due to pipe roughness and fluid compressibility may cause a slight difference between discharge pressure and the pressure on the tool downhole.

By monitoring the tension, the pump rate, and discharge pressure from the pumps, it is possible to monitor and automate actions, which may include increasing pump rate to move the downhole tool faster, or decreasing pump rate to slow or stop the tool from moving downhole. In addition, if the tension is relatively low, then the pumping can be increased to some maximum predefined rate, and if the tension raises too high, then the wireline may be pulling too much on the downhole tool, and an automation routine may choose to slow the rate of the pumps, or to stop pumping entirely, to avoid a potential separation of the wireline from the downhole tool. The automation actions are exemplary, and are not intended to be limiting. Many other exemplary automation actions are described in more detail herein.

As such, embodiments of the present disclosure include an apparatus including a treatment fluid system, a pump-down system, a fluid valve system, and a controller. The treatment fluid system is configured to pump a treatment fluid into a wellbore extending into a subterranean formation from a surface of an oil/gas wellsite. The pump-down system is configured to pump a pump-down fluid into the wellbore to convey a perforating tool through the wellbore. The fluid valve system is configured to selectively fluidly connect and disconnect the treatment fluid system and the pump-down system to and from the wellbore. The controller includes a processor and a memory storing computer program code, and is communicatively connected to the treatment fluid system, the pump-down system, and the fluid valve system. The controller is configured to monitor operational status of the treatment fluid system, the pump-down system, and the fluid valve system. The controller is also configured to control operations of the treatment fluid system, the pump-down system, and the fluid valve system based at least in part on the operational status of the treatment fluid system, the pump-down system, and the fluid valve system.

In addition, embodiments of the present disclosure also include an apparatus including a treatment fluid system, a pump-down system, a fluid valve system, and a controller comprising a processor and a memory storing computer program code. The treatment fluid system is configured to perform well treatment operations by pumping a treatment fluid into a wellbore extending into a subterranean formation from a surface of an oil and gas wellsite. The pump-down system is configured to perform pump-down operations by pumping a pump-down fluid into the wellbore to convey a perforating tool through the wellbore. The fluid valve system is configured to fluidly connect the treatment fluid system to the wellbore during the well treatment operations and the pump-down system to the wellbore during the pump-down operations. The controller is communicatively connected to the treatment fluid system, the pump-down system, and the fluid valve system. The controller is configured to, after the treatment fluid is pumped into the wellbore, operate the fluid valve system to fluidly disconnect the treatment fluid system from the wellbore, operate the fluid valve system to fluidly connect the pump-down system to the wellbore, and perform the pump-down operations by operating the pump-down system to pump the pump-down fluid into the wellbore to convey the perforating tool through the wellbore. The controller is also configured to, after the pump-down fluid is pumped into the wellbore and the perforating tool is retrieved from the wellbore, operate the fluid valve system to fluidly disconnect the pump-down system from the wellbore, operate the fluid valve system to fluidly connect the treatment fluid system to the wellbore, and perform the well treatment operations by operating the treatment fluid system to pump the treatment fluid into the wellbore.

In addition, embodiments of the present disclosure also include an apparatus including a treatment fluid system, a pump-down system, a fluid valve system, and a controller comprising a processor and a memory storing computer program code. The treatment fluid system is configured to perform well treatment operations by pumping a treatment fluid into a first wellbore or a second wellbore extending into a subterranean formation from a surface of an oil and gas wellsite. The pump-down system is configured to perform pump-down operations by pumping a pump-down fluid into the first wellbore or the second wellbore to convey a perforating tool within the first wellbore or the second wellbore. The fluid valve system is configured to fluidly connect and disconnect the treatment fluid system to and from the first wellbore or the second wellbore and to fluidly connect and disconnect the pump-down system to and from the first wellbore or the second wellbore. The controller is communicatively connected to the treatment fluid system, the pump-down system, and the fluid valve system. The controller is configured to operate the fluid valve system to simultaneously fluidly disconnect the pump-down system from the first wellbore, fluidly connect the treatment fluid system to the first wellbore to permit pumping of the treatment fluid into the first wellbore, fluidly disconnect the treatment fluid system from the second wellbore, and fluidly connect the pump-down system to the second wellbore to permit pumping of the pump-down fluid into the second wellbore to convey the perforating tool within the second wellbore. As used herein, the terms "simultaneous" and "simultaneously" are intended to mean certain operations that are performed at generally the same time (e.g., concurrently). In other words, simultaneous operations are intended to mean operations that at least partially overlap in time.

FIG. 1 is a schematic view of at least a portion of an example implementation of a wellsite system 100, in accordance with embodiments of the present disclosure. FIG. 1 illustrates multiple wellbores 102 each extending from a terrain surface of a wellsite 104, a partial sectional view of a subterranean formation 106 penetrated by the wellbores 102, and various pieces of wellsite equipment or components of the wellsite system 100 located at the wellsite 104. The wellsite system 100 may facilitate recovery of oil, gas, and/or other materials that are trapped in the subterranean formation 106. In certain embodiments, each wellbore 102 may include a casing 108 secured by cement (not shown). The wellsite system 100 may be configured to transfer various materials and additives from corresponding sources to a destination location for blending or mixing and subsequent injection into one or more of the wellbores 102 during fracturing and other stimulation operations. In certain embodiments, such operations may be partially or fully automated using at least one controller, as described in greater detail herein.

In certain embodiments, the wellsite system 100 may include a mixing unit 109 (referred to hereinafter as a "mixer") fluidly connected to one or more tanks 110 and a container 112. In certain embodiments, the container 112 may contain a first material and the tanks 110 may contain a liquid. In certain embodiments, the first material may be or include a hydratable material or gelling agent, such as cellulose, clay, galactomannan, guar, polymers, synthetic polymers, and/or polysaccharides, among other examples. In addition, in certain embodiments, the liquid may be or include an aqueous fluid, such as water or an aqueous solution including water, among other examples. In certain embodiments, the mixer 109 may be configured to receive the first material and the liquid, via two or more conduits or other material transfer means (hereafter simply "conduits") 114, 116, and mix or otherwise combine the first material and the liquid to form a base fluid, which may be or include what is known in the art as a gel. In certain embodiments, the mixer 109 may then discharge the base fluid via one or more conduits 118.

In certain embodiments, the wellsite system 100 may further include another mixer 124 fluidly connected to the mixer 109 and another container 126. In certain embodiments, the container 126 may contain a second material that may be appreciably different than the first material. For example, the second material may be or include a proppant material, such as quartz, sand, sand-like particles, silica, and/or propping agents, among other examples. In certain embodiments, the mixer 124 may be configured to receive the base fluid from the mixer 109 via the one or more conduits 118, and the second material from the container 126 via one or more conduits 128, and mix or otherwise combine the base fluid and the second material to form a mixed fluid, which may be or include what is known in the art as a fracturing fluid. In certain embodiments, the mixer 124 may then discharge the mixed fluid via one or more conduits 130.

In certain embodiments, the mixed fluid may be communicated from the mixer 124 to a common manifold 136 via the one or more conduits 130. In certain embodiments, the common manifold 136 may include a low-pressure distribution manifold 138, a high-pressure collection and discharge manifold 140, as well as various valves and diverters, which may be collectively configured to direct the flow of the mixed fluid in a predetermined manner. In certain embodiments, the common manifold 136 may receive the mixed fluid from the one or more conduits 130 and distribute the mixed fluid to a fleet of pump units 150 via the low-pressure distribution manifold 138. The common manifold 136 may be known in the art as a missile or a missile trailer. Although the fleet is illustrated as including four pump units 150, in other embodiments, the fleet may include other quantities of pump units 150 within the scope of the present disclosure.

Each pump unit 150 may include a pump 152, a prime mover 154, and perhaps a heat exchanger 156. In certain embodiments, each pump unit 150 may receive the mixed fluid from a corresponding outlet of the low-pressure distribution manifold 138 of the common manifold 136, via one or more conduits 142, and discharge the mixed fluid under pressure into a corresponding inlet of the high-pressure collection and discharge manifold 140 via one or more conduits 144. In certain embodiments, the mixed fluid may then be discharged from the high-pressure collection and discharge manifold 140 via one or more conduits 146.

The tanks 110, the containers 112, 126, the mixers 109, 124, the pump units 150, the manifold 136, and the conduits 114, 116, 118, 128, 130, 142, 144, 146 may collectively form a treatment (e.g., stimulation) fluid system. As described herein, the treatment fluid system of the wellsite system 100 may be configured to transfer additives and produce a fracturing fluid that may be pressurized and injected into a selected wellbore 102 during hydraulic fracturing operations. However, it is to be understood that the treatment fluid system may also or instead be configured to transfer other additives and mix other treatment fluids that may be pressurized and injected into the selected wellbore 102 during other well and/or reservoir treatment operations, such as acidizing operations, chemical injection operations, and other stimulation operations, among other examples. Accordingly, unless described otherwise, the one or more mixed fluids being produced and pressurized by the treatment fluid system for injection into a selected wellbore 102 may be referred to hereinafter simply as "a treatment fluid."

In certain embodiments, the treatment fluid may be received by a fracturing manifold 170, which may selectively distribute the treatment fluid between the wellbores 102 via a plurality of corresponding fluid conduits 172 extending between the fracturing manifold 170 and each wellbore 102. In certain embodiments, the fracturing manifold 170 may include a plurality of remotely operated fluid flow control valves 173 (e.g., frac valves, shut-off valves), each remotely operable to fluidly connect (and disconnect) the fluid conduit 146 to (and from) a selected one or more of the fluid conduits 172 and, thus, facilitate injection of the treatment fluid into a selected one or more of the wellbores 102. The fracturing manifold 170 may be known in the art as a zipper manifold.

Each wellbore 102 may be capped by a plurality (e.g., a stack) of fluid flow control devices 174, 176, which may include or form a Christmas tree (e.g., a frac tree) including fluid flow control valves (e.g., master valves, wing valves, swab valves, etc.), spools, flow crosses (e.g., goat heads, frac heads, etc.), and fittings individually and/or collectively configured to direct and control (e.g., permit and prevent) flow of the treatment fluid into the wellbore 102 and to direct and control flow of formation fluids out of the wellbore 102. In certain embodiments, the fluid flow control valves of the fluid flow control device 174, 176 may be configured to close selected tubulars or pipes, such as the casing 108 or production tubing extending within the wellbore 102, to selectively facilitate fluid access to the wellbore 102. In certain embodiments, the fluid flow control devices 174, 176 may also include or form a blow-out preventer (BOP) stack selectively operable to prevent flow of the formation fluids out of the wellbore 102. In certain embodiments, the fluid flow control devices 174, 176 may be directly or indirectly mounted on top of a wellhead 178 (e.g., tubing head adapter) terminating the wellbore 102 at the surface of the wellsite 104. In certain embodiments, each fluid flow control valve 173 of the fracturing manifold 170 may be fluidly connected to a corresponding fluid flow control device 174 via one or more fluid conduits 172, to facilitate selective fluid connection between the common manifold 136 and one or more of the wellbores 102. Thus, the fluid flow control valves 173 of the fracturing manifold 170 and the fluid flow control valves of the fluid flow control devices 174, 176 may collectively form a fluid flow control valve system configured to fluidly connect (and disconnect) one of the treatment fluid system and a pump-down system, as described herein, to (and from) a selected one or more of the wellbores 102.

In certain embodiments, a downhole intervention and/or sensor assembly, referred to herein as a tool string 180, may be conveyed within a selected one of the wellbores 102 via a conveyance line 182 operably coupled with one or more pieces of equipment at the wellsite 104. In certain embodiments, the tool string 180 may include a perforating tool configured to perforate the casing 108 and a portion of the formation 106 surrounding the wellbore 102 during perforating operations. In certain embodiments, the conveyance line 182 may be or include a cable, a wireline, a slickline, a multiline, an e-line, coiled tubing, and/or other conveyance means.

In certain embodiments, the conveyance line 182 may be operably connected to a conveyance device 184 (e.g., a wireline or coiled tubing conveyance unit) configured to apply an adjustable tension to the tool string 180 via the conveyance line 182 to convey the tool string 180 through the wellbore 102. In certain embodiments, the conveyance device 184 may be or include a winch conveyance system including a reel or drum 186 storing thereon a wound length of the conveyance line 182. The drum 186 may be rotated by a rotary actuator (e.g., an electric motor, a hydraulic motor, etc.) (not shown) to selectively unwind and wind the conveyance line 182 to apply an adjustable tensile force to the tool string 180 to selectively convey the tool string 180 into and out of the wellbore 102. In certain embodiments, the conveyance line 182 may be directed, guided, and/or injected (e.g., pushed downhole) into the wellbore 102 by an injection device 188 (e.g., a sheave, a pulley, a coiled tubing injector), one or more of which may be supported above the wellbore 102 via a mast, a derrick, a crane, and/or another support structure (not shown). In certain embodiments, the conveyance line 182 may include and/or be operable in conjunction with means for communication between the tool string 180, the conveyance device 184, and/or one or more other portions of the surface equipment, including a tool string control system.

The tool string 180 may be deployed into or retrieved from the wellbore 102 via the conveyance device 184 through the fluid flow control devices 174, 176, the wellhead 178, and/or a sealing and alignment assembly 189 mounted on the fluid flow control devices 174, 176 and configured to seal the conveyance line 182 during deployment, conveyance, intervention, and other wellsite operations performed via the tool string 180. The injection device 188 may, thus, guide the conveyance line 182 between the conveyance device 184 and the sealing and alignment assembly 189. In certain embodiments, the sealing and alignment assembly 189 may include a lock chamber (e.g., a lubricator, an airlock, a riser, etc.) mounted on the fluid flow control devices 174, 176, and a stuffing box configured to seal around the conveyance line 182 at the top of the lock chamber. In certain embodiments, the stuffing box may be configured to seal around an outer surface of the conveyance line 182, such as via annular packings applied around the surface of the conveyance line 182 and/or by injecting a fluid between the outer surfaces of the conveyance line 182 and an inner wall of the stuffing box.

In certain embodiments, the sealing and alignment assembly 189 and the injection device 188 may be disconnected from above a wellbore 102 that was perforated and is now ready for stimulation (e.g., fracturing operations), and may be installed or connected above a wellbore 102 that is to be perforated in preparation for stimulation. In certain embodiments, the sealing and alignment assembly 189 and the injection device 188 may be moved from wellbore 102 to wellbore 102 and supported above a wellbore 102 by a crane or other lifting equipment. The conveyance device 184, the sealing and alignment assembly 189, the injection device 188, the tool string 180, and the conveyance line 182 may collectively form at least a portion of a perforating system configured to convey the tool string 180 (including a perforating tool) within and out of a wellbore 102 and to perforate the wellbore 102.

In certain embodiments, the wellsite system 100 may further include a pump-down system configured to inject a fluid (e.g., water) into a selected one of the wellbores 102 to perform pump-down operations to convey the tool string 180 to an intended depth along the wellbore 102. The pump-down operations may be utilized to move the tool string 180 along the wellbore 102 to facilitate wellbore plugging and perforating ("plug and perf") operations. For example, the tool string 180 may be conveyed through the wellbore 102 to fluidly isolate an upper formation zone that has not yet been perforated from a lower formation zone that has already been perforated, and then perforate the upper formation zone. In certain embodiments, the pumping system may include a pump unit 190 configured to inject the fluid from a fluid container 194 into the selected one of the wellbores 102 containing the tool string 180 via a corresponding fluid flow control device 176 (or wellhead 178). Each pump unit 190 may include a fluid pump 192, a prime mover 193 for actuating the fluid pump 192, and perhaps a heat exchanger 195. In certain embodiments, the fluid pump 192 of the pump unit 190 may be fluidly connected to the fluid container 194 and to each fluid flow control device 176 (which may be or form a portion of the wellhead 178) via a plurality of conduits 196, which may be or form a fluid distribution manifold. In certain embodiments, pump-down and plug and perf operations may be performed in a selected wellbore 102 while stimulation operations are simultaneously performed in one or more other wellbores 102. Accordingly, when a wellbore 102 is selected to be plugged and perforated, the sealing and alignment assembly 189, the injection device 188, and the conveyance device 184 may be installed at and/or moved to the selected wellbore 102. Then, the tool string 180 may be conveyed through the wellbore 102 via the pump-down operations and utilized to perform the plug and perf operations.

In certain embodiments, the fracturing manifold 170 may include an arrangement of flow fittings and manual and remotely actuated fluid flow control valves 173, and may be configured to selectively isolate wellbores 102 by directing the treatment fluid from the common manifold 136 to a selected one or more of the wellbores 102 in which plug and perf operations have been completed and are ready to be fractured. Such operation of the fracturing manifold 170 (which may be automated or semi-automated using at least one controller, in certain embodiments) may improve the speed of transitioning between wellbores 102, and may reduce or eliminate manual adjustments, which may also reduce safety risks. Thus, the fracturing manifold 170 may be configured to facilitate "zipper" fracturing operations, which may provide improved (perhaps nearly continuous) utilization of the frac crew and equipment, resulting in substantial improvement to the effective use of the fracturing resources and, thus, to the overall economics of the well.

In certain embodiments, the wellsite system 100 may include one or more control centers 160, each having a controller 161 (e.g., a processing device, a computer, a programmable logic controller (PLC), etc.), which may be configured to monitor and provide control to one or more portions of the wellsite system 100. The controller(s) 161 may monitor and control corresponding equipment of the treatment fluid system, the pump-down system (e.g., the pump unit 190), the plug and perf system (e.g., the conveyance device 184, the tool string 180), and the flow control valve system (e.g., the fracturing manifold 170, the fluid flow control devices 174, 176). In certain embodiments, the controller(s) 161 may be communicatively connected to the various wellsite equipment described herein, and perhaps other equipment, and may be configured to receive sensor signals from and transmit control signals to such equipment to facilitate automated or semi-automated operations described herein. For example, the controller(s) 161 may be communicatively connected to and configured to monitor and control one or more portions of the mixers 109, 124, the pump units 150, 190, the common manifold 136, the fracturing manifold 170, the fluid flow control devices 174, 176, the injection device 188, the conveyance device 184, and/or various other wellsite equipment (not shown). The controller(s) 161 may store control commands, operational parameters and set-points, coded instructions, executable programs, and other data or information, including for implementing one or more aspects of the operations described herein. Communication between the control center(s) 160 (and the controller(s) 161) and the various wellsite equipment of the wellsite system 100 may be implemented via wired and/or wireless communication means. For clarity and ease of understanding, such communication means are not depicted, and a person having ordinary skill in the art will appreciate that such communication means are within the scope of the present disclosure.

A field engineer, equipment operator, or field operator 164 (collectively referred to hereinafter as a "wellsite operator") may operate one or more components, portions, or systems of the wellsite equipment and/or perform maintenance or repair on the wellsite equipment. For example, the wellsite operator 164 may assemble the wellsite system 100, operate the wellsite equipment (e.g., via a controller 161) to perform the stimulation operations, check equipment operating parameters, and repair or replace malfunctioning or inoperable wellsite equipment, among other operational, maintenance, and repair tasks, collectively referred to hereinafter as wellsite operations. The wellsite operator 164 may perform wellsite operations by himself or with other wellsite operators.

In certain embodiments, the controller(s) 161 may be communicatively connected to one or more human-machine interface (HMI) devices, which may be utilized by the wellsite operator(s) 164 for entering or otherwise communicating the control commands to the controller(s) 161, and for displaying or otherwise communicating information from the controller(s) 161 to the wellsite operator(s) 164. In certain embodiments, the HMI devices may include one or more input devices 167 (e.g., a keyboard, a mouse, a joystick, a touchscreen, etc.) and one or more output devices 166 (e.g., a video monitor, a printer, audio speakers, etc.). In certain embodiments, the HMI devices may also include a mobile communication device(s) 168 (e.g., a smart phone).

In certain embodiments, one or more of the containers 112, 126, 194, the mixers 109, 124, the pump units 150, 190, the fracturing manifold 170, the conveyance device 184, and the control center(s) 160 may each be disposed on corresponding trucks, trailers, and/or other mobile carriers 122, 134, 198, 120, 132, 148, 197, 171, 185, 162, respectively, such as may permit their transportation to the wellsite 104. However, in certain embodiments, one or more of the containers 112, 126, 194, the mixers 109, 124, the pump units 150, 190, the fracturing manifold 170, the conveyance device 184, and the control center(s) 160 may each be skidded or otherwise stationary, and/or may be temporarily or permanently installed at the wellsite 104. In certain embodiments, the common manifold 136 and/or other equipment described herein or otherwise forming a portion of the system 100 may similarly be mobile, skidded, or otherwise installed at the wellsite 104.

Figure 2:
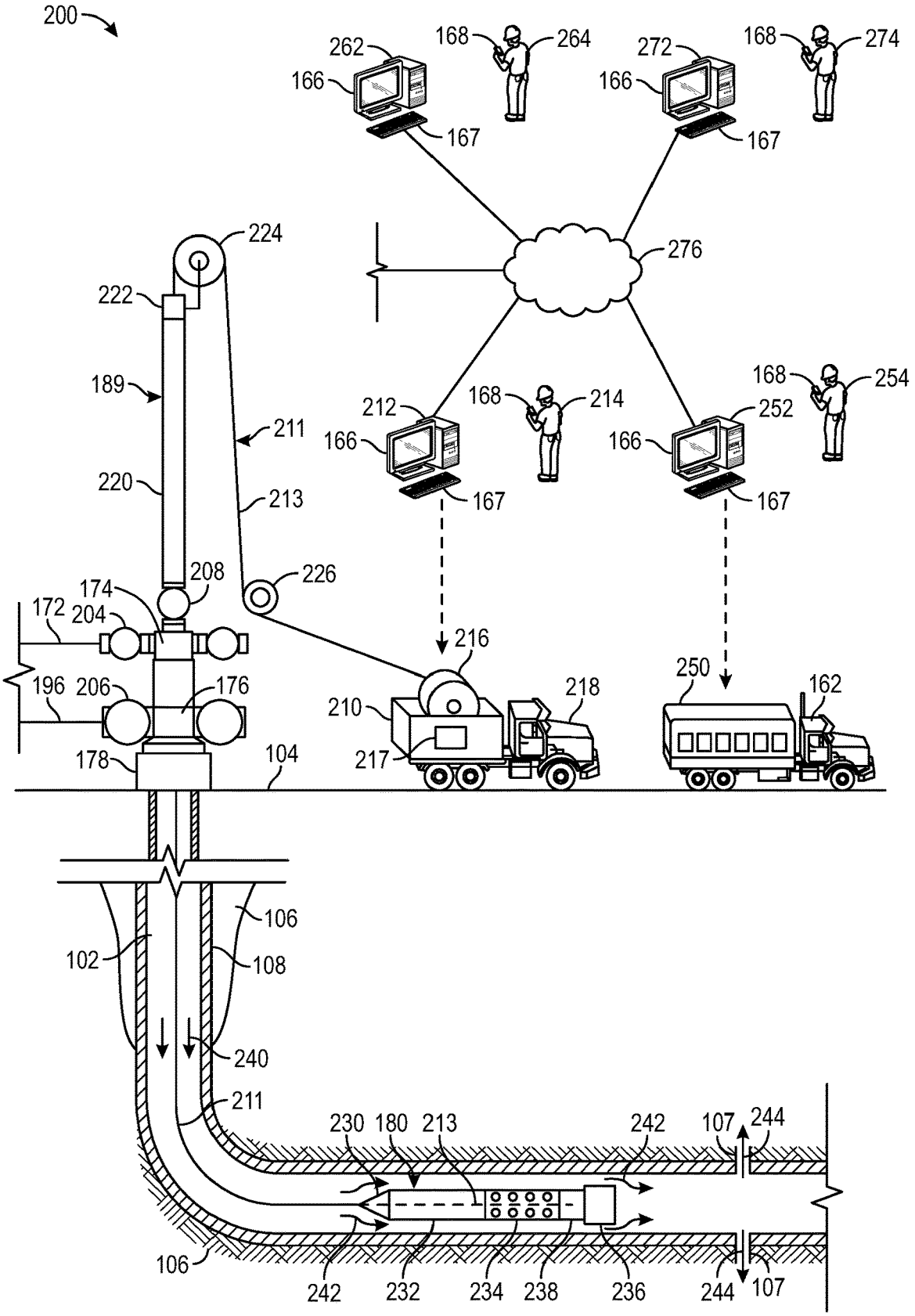
FIG. 2 is a schematic view of a portion of an example implementation of the wellsite system shown in FIG. 1, in accordance with embodiments of the present disclosure.

FIG. 2 is a schematic view of a portion of an example implementation of the wellsite system 100 shown in FIG. 1 and indicated in FIG. 2 by reference numeral 200. The wellsite system 200 shows some of the wellsite equipment of the wellsite system 100 shown in FIG. 1, including where indicated by the same reference numerals. The following description refers to FIGS. 1 and 2, collectively.

The wellsite system 200 includes one of the wellbores 102 extending from the surface of the wellsite 104 into the rock formation 106. In certain embodiments, the wellbore 102 may be capped by the wellhead 178 terminating the wellbore 102 at the surface of the wellsite 104. In certain embodiments, the fluid flow control devices 174, 176 may be mounted on top of the wellhead 178. In certain embodiments, the fluid flow control device 174 may be fluidly connected to the fracturing manifold 170 via a corresponding conduit 172. In certain embodiments, the fluid flow control device 176 may be fluidly connected to the pump unit 190 via a corresponding conduit 196. In certain embodiments, each fluid flow control device 174, 176 may include a plurality of manually and/or remotely (e.g., electrically, pneumatically, hydraulically) operated (i.e., actuated) fluid flow control valves, each configured to selectively open and close selected tubulars or pipes, such as the casing 108 extending within the wellbore 102, to a corresponding fluid conduit 172, 196. For example, the fluid flow control device 174 may include a remotely operated fluid flow control valve 204 (e.g., a wing valve) remotely configured to fluidly connect the conduit 172 to the wellbore 102 and, thus, fluidly connect the fracturing manifold 170 to the wellbore 102. In certain embodiments, the fluid flow control device 174 may further include a remotely operated access valve 208 (e.g., swab valve) remotely configured to open top of the fluid flow control device 174 to permit vertical access to the wellbore 102 by a tool string 180. In certain embodiments, the fluid flow control device 176 may include a remotely operated fluid flow control valve 206 (e.g., wing valve) remotely configured to fluidly connect the conduit 196 to the wellbore 102 and, thus, fluidly connect the pump unit 190 to the wellbore 102.

In certain embodiments, the tool string 180 may be conveyed through the wellbore 102 via a conveyance line 211 operably coupled with a winch conveyance device 210. In certain embodiments, the conveyance line 211 may be operably connected to the conveyance device 210 that is configured to apply an adjustable tension to the tool string 180 via the conveyance line 211 to convey the tool string 180 through the wellbore 102. In certain embodiments, the conveyance device 210 may be or include a winch conveyance system including a reel or drum 216 storing thereon a wound length of the conveyance line 211. In certain embodiments, the drum 216 may be rotated by a rotary actuator 217 (e.g., an electric motor, a hydraulic motor, etc.) to selectively unwind and wind the conveyance line 211 to apply an adjustable tensile force to the tool string 180 to selectively convey the tool string 180 along the wellbore 102. In certain embodiments, the conveyance device 210 may be carried by a truck, trailer, or another vehicle 218.

In certain embodiments, the pump unit 190 may be configured to inject a fluid (e.g., water) into each wellbore 102 via the conduits 196 to perform pump-down operations to convey the tool string 180 to an intended depth along the wellbore 102. The pump-down operations may be utilized to move the tool string 180 along the wellbore 102 to facilitate the plug and perf operations. As described herein, the tool string 180 may be conveyed through the wellbore 102 to fluidly isolate an upper portion of the wellbore 102 extending through an upper formation zone that has not yet been perforated from a lower portion of the wellbore 102 extending through a lower formation zone that has already been perforated, and then perforate the upper formation zone.

In certain embodiments, the conveyance device 210 may include a controller 212 communicatively connected to the winch device 210 and the tool string 180, such as may permit the controller 212 to receive sensor signals from and transmit control signals to such equipment to convey the tool string 180 downhole and perform various downhole operations described herein. In certain embodiments, the controller 212 may be electrically or otherwise communicatively connected to the rotary actuator 217 of the drum 216 to selectively unwind and wind the conveyance line 211 to apply an adjustable tensile force to the tool string 180 to selectively convey the tool string 180 into and out of the wellbore 102. In certain embodiments, the controller 212 may be electrically or otherwise communicatively connected to the tool string 180 via a conductor 213 extending through at least a portion of the tool string 180, through the conveyance line 211, and externally from the conveyance line 211 at the wellsite surface 104 via a rotatable joint or coupling (e.g., a collector) carried by the drum 216. In certain embodiments, the conductor 213 may transmit and/or receive electrical power, data, and/or control signals between the controller 212 and one or more portions of the tool string 180. In certain embodiments, the controller 212 may be communicatively connected to the tool string 180 and/or various portions thereof, such as various sensors and actuators of the tool string 180, via the conductor 213 to facilitate monitoring and/or control operations of the tool string 180.

The controller 212 may be communicatively connected to one or more HMI devices, which may be utilized by a wellsite operator 214 (e.g., tool string operator, winch conveyance system 210 operator) for entering or otherwise communicating control commands to the controller 212, and for displaying or otherwise communicating information from the controller 212 to the wellsite operator 214. The HMI devices may include one or more input devices 167 and one or more output devices 166. The HMI devices may also include a mobile communication device 168 carried by the wellsite operator 214.

In certain embodiments, the tool string 180 may be deployed into or retrieved from the wellbore 102 through the fluid flow control devices 174, 176, the access valve 208, and a sealing and alignment assembly 189 mounted above the access valve 208 and configured to seal the conveyance line 211 during deployment, conveyance, intervention, and other wellsite operations performed by the tool string 180. In certain embodiments, the sealing and alignment assembly 189 may include a lock chamber 220 (e.g., a lubricator, an airlock, a riser) mounted above the access valve 208, a stuffing box 222 configured to seal around the line 211 at the top of the lock chamber 220, and an injection device 224 (i.e., a pulley) configured to guide the line 211 into the stuffing box 222. In certain embodiments, a guide pulley 226 may guide the line 211 between the injection device 224 and the conveyance device 210. In certain embodiments, the stuffing box 222 may be configured to seal around an outer surface of the line 211, such as via annular packings applied around the surface of the line 211 and/or by injecting a fluid between the outer surface of the line 211 and an inner wall of the stuffing box 222.

In certain embodiments, the conveyance line 211 may be or include a flexible conveyance line, such as a wire, a cable, a wireline, a slickline, a multiline, an e-line, and/or other conveyance means. In certain embodiments, the conveyance line 211 may include one or more metal support wires or cables configured to support the weight of the downhole tool string 180. In certain embodiments, the conveyance line 211 may also include one or more electrical and/or optical conductors 213 configured to transmit electrical energy (i.e., electrical power) and electrical and/or optical signals (e.g., information, data) therethrough, such as may permit the transmission of electrical energy, data, and/or control signals between the tool string 180 and the controller 212.

In certain embodiments, the tool string 180 may include a cable head 230 physically and/or electrically connecting the conveyance line 211 to the tool string 180, such as may permit the tool string 180 to be suspended and conveyed through the wellbore 102 via the conveyance line 211. In certain embodiments, the cable head 230 may provide telemetry and/or power distribution to the tool string 180. The tool string 180 may include at least a portion of one or more downhole devices, modules, subs, and/or other tools 232 configured to perform intended downhole operations. In certain embodiments, the tools 232 of the tool string 180 may include a telemetry/control tool, such as may facilitate communication between the tool string 180 and the controller 212 and/or control of one or more portions of the tool string 180. In certain embodiments, the telemetry/control tool may include a downhole controller (not shown) communicatively connected to the controller 212 via the conductor 213 and to other portions of the tool string 180. In certain embodiments, the tools 232 of the tool string 180 may further include one or more inclination and/or directional sensors, such as one or more accelerometers, magnetometers, gyroscopic sensors (e.g., micro-electro-mechanical system (MEMS) gyros), and/or other sensors for determining the orientation and/or direction of the tool string 180 within the wellbore 102. In certain embodiments, the tools 232 of the tool string 180 may also include a depth correlation tool, such as a casing collar locator (CCL) for detecting ends of casing collars by sensing a magnetic irregularity caused by the relatively high mass of an end of a collar of the casing 108. In certain embodiments, the depth correlation tool may also or instead be or include a gamma ray (GR) tool that may be utilized for depth correlation.

In certain embodiments, the tool string 180 may also include one or more perforating guns or tools 234 configured to perforate or form holes though the casing 108, the cement, and the portion of the formation 106 surrounding the wellbore 102 to prepare the well for fracturing. In certain embodiments, each perforating tool 234 may contain one or more shaped explosive charges operable to perforate the casing 108, the cement, and the formation 106 upon detonation. In certain embodiments, the tool string 180 may also include a plug 236 and a plug setting tool 238 that, when activated, sets the plug 236 at a predetermined position within the wellbore 102, such as to isolate or seal an upper portion (e.g., zone) of the wellbore 102 from a lower portion (e.g., zone) of the wellbore 102 and, in certain embodiments, disconnects the borehole assembly (BHA) from the plug 236. The plug 236 may be permanent or retrievable, facilitating the lower portion (e.g., zone) of the wellbore 102 to be permanently or temporarily isolated or sealed from the upper portion (e.g., zone) of the wellbore 102 before perforating operations.

Figure 6:
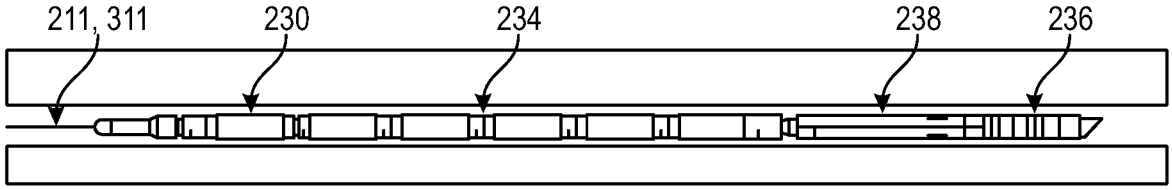
FIG. 6 is a cutaway side view of a portion of an example tool string, in accordance with embodiments of the present disclosure.

FIG. 6 is a cutaway side view of a portion of an example tool string 180, in accordance with embodiments of the present disclosure. The benefit of the pump-down perforating techniques described herein of effectively locating the perforating gun 234 of multiple perforating guns 234 of a BHA is shown. That is, pump-down techniques may be used as described herein to position the BHA in a horizontal section of the well for perforating. As illustrated, the BHA includes both perforating guns 234 as well as a plug 236 and setting tool 238 for securing and isolating the depicted well section for the perforating application. With reference to the discussion herein, the power- and telemetry-equipped head 230 of the assembly may be used to further aid in automating the deployment as described in greater detail herein by, for example, providing communication of downhole sensor measurements in real-time (e.g., while the pump-down perforating operations are being performed).

Returning to FIG. 2, in certain embodiments, the treatment fluid system may further include a control center 250 containing a controller 252 (e.g., a processing device, a computer, a PLC, etc.), which may be configured to monitor and provide control to one or more portions of the treatment fluid system. The controller 252 may be communicatively connected to the various equipment of the treatment fluid system and may be configured to receive sensor signals from and transmit control signals to such equipment to facilitate automated or semi-automated operations described herein. For example, the controller 252 may be communicatively connected to and configured to monitor and control one or more portions of the mixers 109, 124, the pump units 150, the common manifold 136, and/or various other wellsite equipment (not shown). The controller 252 may store control commands, operational parameters and set-points, coded instructions, executable programs, and other data or information, including for implementing one or more aspects of the operations described herein. Communication between the control center 250 (and the controller 252) and the various equipment of the treatment fluid system may be implemented via wired and/or wireless communication means. For clarity and ease of understanding, such communication means are not depicted, and a person having ordinary skill in the art will appreciate that such communication means are within the scope of the present disclosure.

In certain embodiments, the controller 252 may be communicatively connected to one or more HMI devices, which may be utilized by a wellsite operator 254 (e.g., fracturing system operator) for entering or otherwise communicating control commands to the controller 252, and for displaying or otherwise communicating information from the controller 252 to the wellsite operator 254. In certain embodiments, the HMI devices may include one or more input devices 167 and one or more output devices 166. In addition, in certain embodiments, the HMI devices may also include a mobile communication device 168 carried by the wellsite operator 254.

In certain embodiments, the pump-down system may further include a controller 262 (e.g., a processing device, a computer, a PLC, etc.) disposed in association with the pump unit 190 and/or fluid container 194. The controller 262 may be configured to monitor and provide control to one or more portions of the pump-down system. The controller 262 may be communicatively connected to the various equipment of the pump-down system and may be configured to receive sensor signals from and transmit control signals to such equipment to facilitate automated or semi-automated operations described herein. For example, the controller 262 may be communicatively connected to and configured to monitor and control one or more portions of the pump unit 190, the fluid container 194, and/or various other wellsite equipment (not shown). The controller 262 may store control commands, operational parameters and set-points, coded instructions, executable programs, and other data or information, including for implementing one or more aspects of the operations described herein. Communication between the controller 262 and the equipment of the pump-down system may be implemented via wired and/or wireless communication means. For clarity and ease of understanding, such communication means are not depicted, and a person having ordinary skill in the art will appreciate that such communication means are within the scope of the present disclosure.

In certain embodiments, the controller 262 may be communicatively connected to one or more HMI devices, which may be utilized by a wellsite operator 264 (e.g., pump-down operator) for entering or otherwise communicating control commands to the controller 262, and for displaying or otherwise communicating information from the controller 262 to the wellsite operator 264. In certain embodiments, the HMI devices may include one or more input devices 167 and one or more output devices 166. In addition, in certain embodiments, the HMI devices may also include a mobile communication device 168 carried by the wellsite operator 264.

In certain embodiments, the wellsite systems 100, 200 may further include a central controller 272 (e.g., a processing device, a computer, a PLC, etc.) configured to monitor and provide control to one or more portions of the wellsite systems 100, 200. The controller 272 may store control commands, operational parameters and set-points, coded instructions, executable programs, and other data or information, including for implementing one or more aspects of the operations described herein. The controller 272 may be communicatively connected to the various equipment of the wellsite systems 100, 200 and may be configured to receive sensor signals from and transmit control signals to such equipment to facilitate automated or semi-automated operations described herein. For example, in certain embodiments, the controller 272 may be communicatively connected to the controller 212 and configured to monitor and control one or more portions of the plug and perf system (e.g., the conveyance device 210, the tool string 180) via the controller 212. In addition, in certain embodiments, the controller 272 may be further communicatively connected to the controller 252 and configured to monitor and control one or more portions of the treatment fluid system (e.g., the mixers 109, 124, the pump units 150) via the controller 252. In addition, in certain embodiments, the controller 272 may be further communicatively connected to the controller 262 and configured to monitor and control one or more portions of the pump-down system (e.g., the pump unit 190, the fluid container 194) via the controller 262. In addition, in certain embodiments, the controller 272 may be further communicatively connected to the fluid flow control devices 174, 176 (e.g., the fluid flow control valves 204, 206) and the access valve 208 associated with each wellbore 102 and the fracturing manifold 170 (e.g., fluid flow control valves 173), such as may permit the controller 272 to monitor and control the fluid flow control devices 174, 176, the access valves 208, and the fracturing manifold 170. The controller 272 may, thus, monitor and/or control injection of treatment fluid via the fluid flow control device 174 and injection of water or other fluid via the fluid flow control device 176 into one or more selected wellbores 102.

Communication between the controller 272 and the controllers 212, 252, 262, the fluid flow control devices 174, 176, the access valves 208, and the fracturing manifold 170 may be implemented via wired and/or wireless communication network 276 (e.g., a local area network (LAN), a wide area network (WAN), the internet, etc.). For clarity and ease of understanding, details of such communication means are not depicted, and a person having ordinary skill in the art will appreciate that such communication means are within the scope of the present disclosure.

In certain embodiments, the controller 272 may be communicatively connected to one or more HMI devices, which may be utilized by a wellsite operator 274 for entering or otherwise communicating control commands to the controller 272, and for displaying or otherwise communicating information from the controller 272 to the wellsite operator 274. In certain embodiments, the HMI devices may include one or more input devices 167 and one or more output devices 166. In addition, in certain embodiments, the HMI devices may also include a mobile communication device 168 carried by the wellsite operator 274. In certain embodiments, the controller 272, the HMI devices 166, 167, and the wellsite operator 274 may be located at the wellsite surface 104. For example, the controller 272 may be installed or housed in a control center (e.g., a facility, a trailer, etc.) housing one of the other controllers 212, 252, 262. However, the controller 272, the HMI devices 166, 167, and the wellsite operator 274 may also or instead be located off-site (e.g., a data center) at a distance from the wellsite surface 104.

As described herein, the central controller 272 and/or the wellsite operator 274 using the central controller 272 may monitor and provide control to one or more portions of the wellsite systems 100, 200 via direct communication with selected wellsite equipment and/or indirect communication with selected wellsite equipment via dedicated equipment controllers 212, 252, 262 for controlling such wellsite equipment. For example, during pump-down operations, after the tool string 180 is made up and positioned within a selected one of the wellbores 102 below the wellhead 178, the controller 272 and/or the wellsite operator 274 using the controller 272 may initialize operation of the pump unit 190 to pump a fluid (e.g., water) from the fluid container 194. The controller 272 and/or the wellsite operator 274 may also cause the remotely operated fluid valve 206 of the fluid flow control device 176 to open to permit the fluid to be injected into the wellbore 102 containing the tool string 180. The fluid may be injected into the wellbore 102 when the tool string 180 is conveyed within a vertical portion of the wellbore 102 just below the fluid flow control device 176 or when the tool string 180 stops descending within the wellbore 102 by way of gravity. The fluid injected into the wellbore 102 may flow downhole, as indicated by arrows 240, thereby forming an increased pressure zone behind (i.e., uphole from) the tool string 180 that is greater than fluid pressure in front of (i.e., downhole from) the tool string 180. Such pressure differential may push or otherwise impart a downhole-directed force operable to move the tool string 180 in the downhole direction. The fluid flowing downhole 240 may also or instead cause friction or drag while the fluid flows around or past the tool string 180, as indicated by arrows 242. The friction may drag or otherwise impart a downhole-directed force operable to move the tool string 180 in the downhole direction. During the pump-down operations, the fluid passing 242 the tool string 180 may escape from the wellbore 102 into the formation 106 in front of the tool string 180 via previously made perforations 107, as indicated by arrows 244, thereby permitting the fluid pumped into the wellbore 102 to continually flow around or past the tool string 180 until the tool string 180 is conveyed to an intended depth within the wellbore 102.

In certain embodiments, while the fluid is being injected into the wellbore 102 by the fluid pump unit 190 during the pump-down operations, the controller 272 and/or the wellsite operator 274 may operate the conveyance device 210 to selectively rotate the drum 216 to unwind the conveyance line 211 to permit the pumped fluid to move the tool string 180 downward along the wellbore 102 at an intended speed and to an intended depth. In certain embodiments, after the tool string reaches the intended depth, the controller 272 and/or the wellsite operator 274 may shut off the pump unit 190 and close the fluid flow control valve 206.

In certain embodiments, while the fluid is being injected into the wellbore 102 by the fluid pump unit 190 during the pump-down operations, the controller 272 and/or the wellsite operator 274 may also operate the treatment fluid system to mix and pump the treatment fluid, open the fluid flow control valve 204 of the fluid flow control device 174, and operate a corresponding fluid flow control valve 173 of the fracturing manifold 170 of one or more of the other wellbores 102 not undergoing the pump-down operations to direct the treatment fluid therein.

In certain embodiments, after the plug and perf operations of the wellbore 102 are complete, the controller 272 and/or the wellsite operator 274 may operate the conveyance device 210 to pull the tool string 180 out of the wellbore 102 through the fluid flow control devices 174, 176 and close the access valve 208. Thereafter, the controller 272 and/or the wellsite operator 274 may operate the treatment fluid system to mix and pump the treatment fluid, open the fluid flow control valve 204 of the fluid flow control device 174, and operate a corresponding fluid flow control valve 173 of the fracturing manifold 170 to direct the treatment fluid into the newly perforated wellbore 102.

Figure 3:
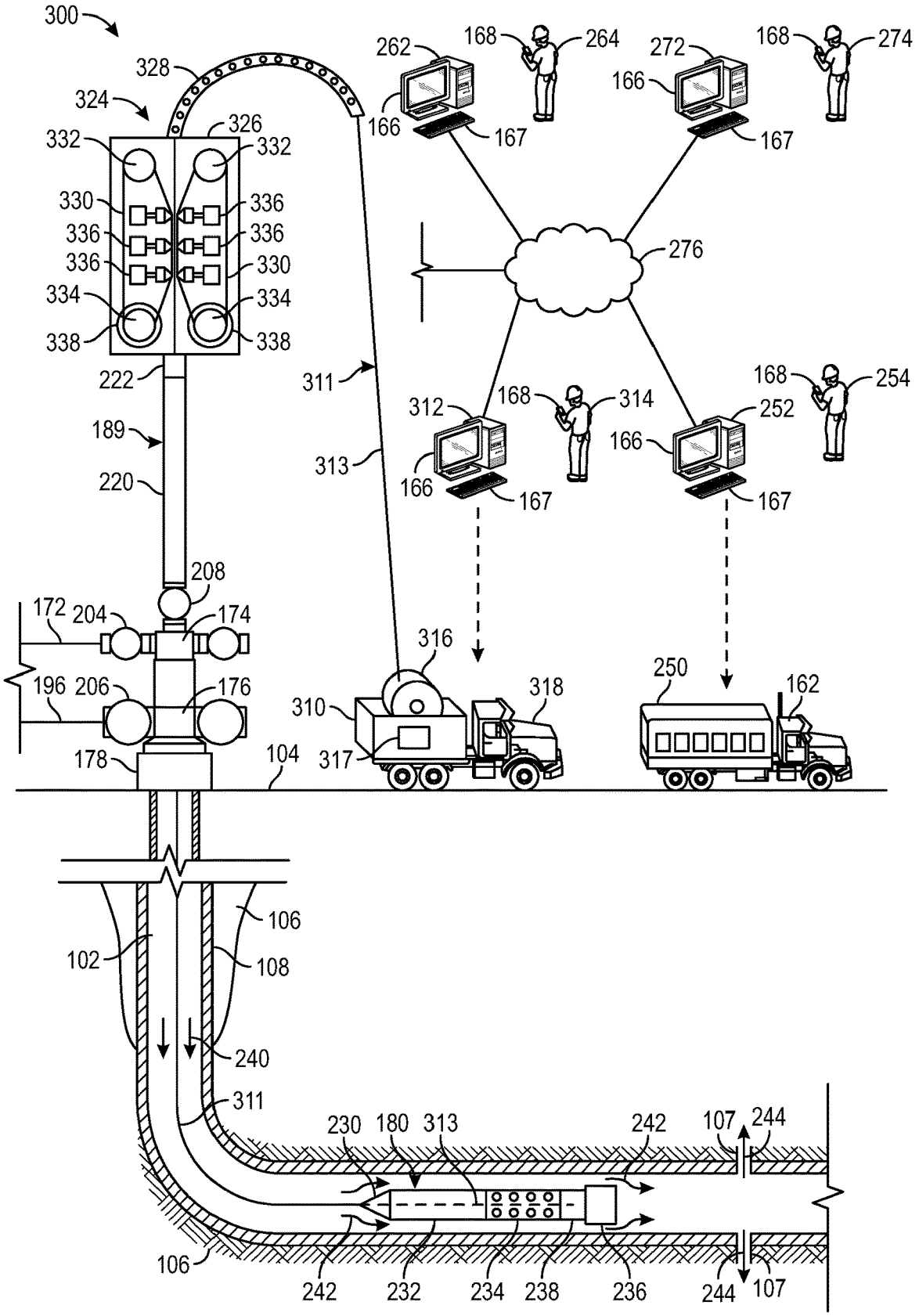
FIG. 3 is a schematic view of a portion of an example implementation of the wellsite system shown in FIG. 1, in accordance with embodiments of the present disclosure.

FIG. 3 is a schematic view of a portion of an example implementation of the wellsite system 100 shown in FIG. 1 and indicated in FIG. 3 by reference numeral 300. The wellsite system 300 shows some of the wellsite equipment of the wellsite systems 100, 200 shown in FIGS. 1 and 2, respectively, including where indicated by the same reference numerals. The following description refers to FIGS. 1 and 3, collectively.

The wellsite system 300 includes one of the wellbores 102 extending from the surface of the wellsite 104 into the formation 106. In certain embodiments, the wellbore 102 may be capped by the wellhead 178 terminating the wellbore 102 at the surface of the wellsite 104. In certain embodiments, the fluid flow control devices 174, 176 may be mounted on top of the wellhead 178. In certain embodiments, the fluid flow control device 174 may be fluidly connected to the fracturing manifold 170 via a corresponding conduit 172. In certain embodiments, the fluid flow control device 176 may be fluidly connected to the pump unit 190 via a corresponding conduit 196.

In certain embodiments, the tool string 180 may be conveyed through the wellbore 102 via a conveyance line 311 carried by a line storage device 310, which may include a reel or drum 316 storing thereon a wound length of the conveyance line 311. In certain embodiments, the drum 316 may be rotated by a rotary actuator 317 (e.g., an electric motor, a hydraulic motor, etc.) to selectively unwind and wind the conveyance line 311. In certain embodiments, the line storage device 310 may be carried by a truck, trailer, or another vehicle 318.

In certain embodiments, the tool string 180 may be deployed into or retrieved from the wellbore 102 through the fluid flow control devices 174, 176, the access valve 208, and the sealing and alignment assembly 189 that is mounted above the access valve 208 and configured to seal the conveyance line 311 during deployment, conveyance, intervention, and other wellsite operations performed by the tool string 180. In certain embodiments, the sealing and alignment assembly 189 may include a lock chamber 220 (e.g., a lubricator, an airlock, a riser) mounted above the access valve 208, a stuffing box 222 configured to seal around the line 311 at the top of the lock chamber 220, and an injection device 324 (i.e., coiled tubing injector) configured to guide the line 311 into the stuffing box 222. In certain embodiments, the stuffing box 222 may be configured to seal around an outer surface of the line 311, such as via annular packings applied around the surface of the line 311 and/or by injecting a fluid between the outer surface of the line 311 and an inner wall of the stuffing box 222.

In certain embodiments, the conveyance line 311 may be or include coiled tubing. In certain embodiments, the conveyance line 311 may include or contain one or more electrical and/or optical conductors 313 configured to transmit electrical energy (i.e., electrical power) and electrical and/or optical signals (e.g., information, data), such as may permit the transmission of electrical energy, data, and/or control signals between the tool string 180 and the line storage device 310.

In certain embodiments, the injection device 324 may be or include an injector head 326 configured to run and retrieve the line 311 into and out of the wellbore 102. In certain embodiments, a gooseneck 328 may be mounted on top of the injector head 326 to feed or direct a line 311 around a controlled radius into the injector head 326. In certain embodiments, the injector head 326 may include opposing circulating members, such as may be configured to compress or otherwise grip the line 311 to support the weight of the downhole tool string 180 within the wellbore 102. For example, the injector head 326 may be a belt-type injector head including a pair of opposing belts 330 circulated by upper and lower rollers 332, 334. In certain embodiments, a corresponding set of cylinders 336 may push each belt 330 against the line 311 to maintain a sufficient pressure and, thus, friction between the belts 330 and an outer surface of the line 311 to grip the line 311. In certain embodiments, the belts 330 may include rubber, such as EPDM (ethylene propylene diene monomer). However, other embodiments of the injector head 326 may include chains instead of the belts 330. In certain embodiments, the injector head 326 may be mounted to or otherwise above the stuffing box 222 configured to fluidly seal against the line 311 while it exits or enters the injector head 326.

One or more of the rollers 332, 334 may be operated by a corresponding motor 338 mechanically connected to the rollers 332, 334. A gear box or transmission (not shown) may be mechanically or otherwise operatively connected between each motor 338 and the corresponding rollers 332, 334, such as may facilitate control of rotational speed and torque applied to the rollers 332, 334. When the motors 338 are implemented as hydraulic motors, a pump may be driven by an engine or an electric motor (neither shown) to supply hydraulic energy. The hydraulics system may provide variable speed commands. When the motors 338 are implemented as electrical motors, the motors 338 may be electrically connected to an electrical motor controller (e.g., a variable frequency drive, a chopper) (not shown) configured to control the speed and/or torque of the motors 338, such as by controlling the frequency and/or the amplitude of the electrical energy supplied to the motors 338. Although the injector head 326 is shown mounted above the lock chamber 220 and the stuffing box 222, the injector head 326 may be installed or otherwise disposed within the pressure contained volume of the lock chamber 220, below the stuffing box 222.

In certain embodiments, the line storage device 310 and the injection device 324 may include or be associated with a controller 312 communicatively connected to the line storage device 310 and the injection device 324, such as may permit the controller 312 to receive sensor signals from and transmit control signals to such equipment to perform various downhole operations described herein. In certain embodiments, the controller 312 may be electrically or otherwise communicatively connected to the rotary actuator 317 of the drum 316 and to the motors 338 of injection device 324 to selectively unwind and wind the conveyance line 311 to apply an adjustable compressive and tensile force to the line 311 to selectively convey the tool string 180 into and out of the wellbore 102. In certain embodiments, the controller 312 may be electrically or otherwise communicatively connected to the tool string 180 via a conductor 313 extending through at least a portion of the tool string 180, through the conveyance line 311, and externally from the conveyance line 311 at the wellsite surface 104 via a rotatable joint or coupling (e.g., a collector) carried by the drum 316. In certain embodiments, the conductor 313 may transmit and/or receive electrical power, data, and/or control signals between the controller 312 and one or more portions of the tool string 180. In certain embodiments, the controller 312 may be communicatively connected to the tool string 180 and/or various portions thereof, such as various sensors and actuators of the tool string 180, via the conductor 313 to facilitate monitoring and/or control operations of the tool string 180.

In certain embodiments, the controller 312 may be communicatively connected to one or more HMI devices, which may be utilized by a wellsite operator 314 (e.g., tool string operator, coiled tubing system operator, injector head operator) for entering or otherwise communicating control commands to the controller 312, and for displaying or otherwise communicating information from the controller 312 to the wellsite operator 314. In certain embodiments, the HMI devices may include one or more input devices 167 and one or more output devices 166. In addition, in certain embodiments, the HMI devices may also include a mobile communication device 168 carried by the wellsite operator 314.

In certain embodiments, the wellsite systems 100, 300 may further include a central controller 272 configured to monitor and provide control to one or more portions of the wellsite systems 100, 300. The controller 272 may be communicatively connected to the various equipment of the wellsite systems 100, 300 and may be configured to receive sensor signals from and transmit control signals to such equipment to facilitate automated or semi-automated operations described herein. For example, in certain embodiments, the controller 272 may be communicatively connected to the controller 312 and configured to monitor and control one or more portions of the plug and perf system (e.g., the line storage device 310, the injector head 324, and the tool string 180) via the controller 312. In addition, in certain embodiments, the controller 272 may be further communicatively connected to the controller 252 and configured to monitor and control one or more portions of the treatment fluid system via the controller 252. In addition, in certain embodiments, the controller 272 may be further communicatively connected to the controller 262 and configured to monitor and control one or more portions of the pump-down system (e.g., the pump unit 190, the fluid container 194) via the controller 262. In addition, in certain embodiments, the controller 272 may also be communicatively connected to the fluid flow control devices 174, 176 (e.g., the fluid flow control valves 204, 206) and access valve 208 associated with each wellbore 102 and with the fracturing manifold 170 (e.g., fluid flow control valves 173), such as may permit the controller 272 to monitor and control the fluid flow control devices 174, 176 and the fracturing manifold 170. The controller 272 may, thus, monitor and/or control injection of treatment fluid via the fluid flow control device 174 and injection of water or other fluid via the fluid flow control device 176 into one or more selected wellbores 102.

Communication between the controller 272 and the controllers 312, 252, 262, the fluid flow control devices 174, 176, the access valve 208, and the fracturing manifold 170 may be implemented via wired and/or wireless communication network 276 (e.g., a local area network (LAN), a wide area network (WAN), the internet, etc.). For clarity and ease of understanding, details of such communication means are not depicted, and a person having ordinary skill in the art will appreciate that such communication means are within the scope of the present disclosure.

As described herein, the central controller 272 and/or the wellsite operator 274 using the central controller 272 may be configured to monitor and provide control to one or more portions of the wellsite systems 100, 300 via direct communication with wellsite equipment and/or indirect communication with wellsite equipment via dedicated equipment controllers 312, 252, 262 for controlling corresponding wellsite equipment.

In certain embodiments, the line storage device 310 and the injector head 324 may be collectively operated by the central controller 272 and/or the wellsite operator 274 using the central controller 272 to convey the tool string 180 through the wellbore 102 without pumping the fluid into the wellbore 102. In certain embodiments, the conveyance line 311 may be sufficiently rigid to permit conveyance of the tool string 180 to an intended depth along the wellbore 102, including in a deviated or horizontal portion of the wellbore 102. During such conveyance operations, the central controller 272 and/or the wellsite operator 274 using the central controller 272 may operate the line storage device 310 to selectively rotate the drum 316 to unwind the conveyance line 311 and to inject the conveyance line 311 into the wellbore 102 via the injection device 324 to push or otherwise move the tool string 180 downhole along the wellbore 102 at an intended speed and to an intended depth.

In certain embodiments, while the plug and perf operations of the wellbore 102 are being performed, the controller 272 and/or the wellsite operator 274 may also operate the treatment fluid system to mix and pump the treatment fluid, open the fluid flow control valve 204 of the fluid flow control device 174, and operate a corresponding fluid flow control valve 173 of the fracturing manifold 170 of one or more of the other wellbores 102 not undergoing the plug and perf operations to direct the treatment fluid therein. In certain embodiments, after the plug and perf operations of the wellbore 102 are complete, the central controller 272 and/or the wellsite operator 274 using the central controller 272 may operate the fracturing manifold 170 to direct the treatment fluid into such wellbore 102 and/or operate the fluid access valve 204 of the fluid flow control device 174 associated with such wellbore 102 to permit the treatment fluid to be injected into the newly perforated wellbore 102.

The present disclosure is further directed to an example monitoring and control system (or apparatus) (hereinafter "control system") for monitoring and controlling various wellsite equipment of the wellsite systems 100, 200, 300 to perform processes, operations, and methods described herein, including the pump-down operations, the plug and perf operations, the stimulation operations, and various fluid valve transition operations that take place between each of the pump-down operations, the plug and perf operations, and the stimulation operations. In certain embodiments, the control system may include a controller, such as the controller 272, configured to receive sensor data from the wellsite equipment of the wellsite systems 100, 200, 300, process such sensor data, and output control signals to such wellsite equipment to implement the example methods, processes, and/or operations described herein.

In certain embodiments, the controller of the control system may facilitate partially and/or completely automated orchestration (i.e., coordination) across an entire workflow of the well services. The controller may utilize or execute an orchestration (i.e., supervisory) level program (e.g., computer program code, software) that, when executed, may track the workflow and orchestrate each individual operation to ensure optimal operational efficiency. Such automated orchestration across the workflow may link automation and job execution monitoring systems across various well services performed by the wellsite systems 100, 200, 300, including fluid treatment (e.g., stimulation, fracturing) operations, pump-down operations, plug and perf operations, and control operations of the wellhead fluid flow control devices 174, 176 and fracturing manifold 170. The automated orchestration across the workflow may provide visibility to operational status of multiple operations across multiple wells. The controller of the control system may automatically issue control commands (e.g., control signals) to the well services to achieve the optimal efficiency without manual intervention or execution by a wellsite operator 274.

Control operations of the wellsite equipment performed by the controller may be facilitated by the orchestration level program (i.e., intelligence layer), which when executed by the controller, may provide fully orchestrated well services that optimize (e.g., maximize) total active pumping hours per day to achieve optimum stimulation efficiency. Underneath the orchestration level program, there may be other deliverables to advance the automation capability of individual well services.

The controller executing the orchestration level program according to one or more aspects of the present disclosure may ensure or otherwise facilitate optimum efficiency across the well completions cycle. For example, the controller may provide or otherwise facilitate automation orchestration across the workflow, real-time tracking, ability to respond to events automatically, automated tracking of the workflow status across multiple wells, "look-ahead" forecasting for automatically executing subsequent steps in the workflow before responsive manual operation can be implemented, and look-ahead forecasting that visualizes, predicts, or otherwise facilitates planning of maintenance cycles, allocation of equipment and personnel, and material consumption and deliveries for the near future (e.g., 12, 24, 36, 48, or more hours). Accordingly, while a typical well completions cycle include about 12-16 hours of active pumping per day, the controller and/or the orchestration level program within the scope of the present disclosure may facilitate 20 or more hours of active pumping per day.

The orchestration level program according to one or more aspects of the present disclosure may be or include a high-level computer program code configured to facilitate automation orchestration across the workflow, which tracks and coordinates automation commands to the individual well services in the workflow. In certain embodiments, a coordinated controller (e.g., the controller 272) and/or one or more of the local controllers (e.g., the controllers 212, 252, 262, 312) associated with corresponding pieces or subsystems of wellsite equipment may execute the orchestration level program to control the well services described herein. The orchestration level program may be a "score keeper" of the status of the well services across the various wells and may view, predict, or plan an upcoming well service operation to facilitate efficient synchronization cross the workflow. The orchestration level program may include or utilize a schedule optimizer and/or an artificial intelligence engine to manage sequencing of events.

In certain embodiments, the controller executing the orchestration level program according to one or more aspects of the present disclosure may provide or facilitate partially and/or fully automated coordination across the well services provided by the various wellsite equipment of the wellsite systems 100, 200, 300 at a wellsite 104 including multiple wellbores 102. The controller executing the orchestration level program may provide or facilitate continuous stimulation operations through the orchestration of such well services. The well services may have varying levels of individual monitoring and automation. The controller executing the orchestration level program may provide a communication (i.e., monitoring and control) interface for the various wellsite equipment of the wellsite systems 100, 200, 300. For example, the controller may monitor and control stimulation (e.g., fracturing) operations being performed in one of the wellbores 102, the pump-down and plug and perf operations being performed in another one of the wellbores 102, and operational status (i.e., position) of the fluid flow control valves (e.g., the fluid flow control valves 204, 206, the access valve 208, the fluid flow control valves 173) for controlling fluid flow through one or more of the wellheads 178 into the corresponding one or more of the wellbores 102.

Figure 4:
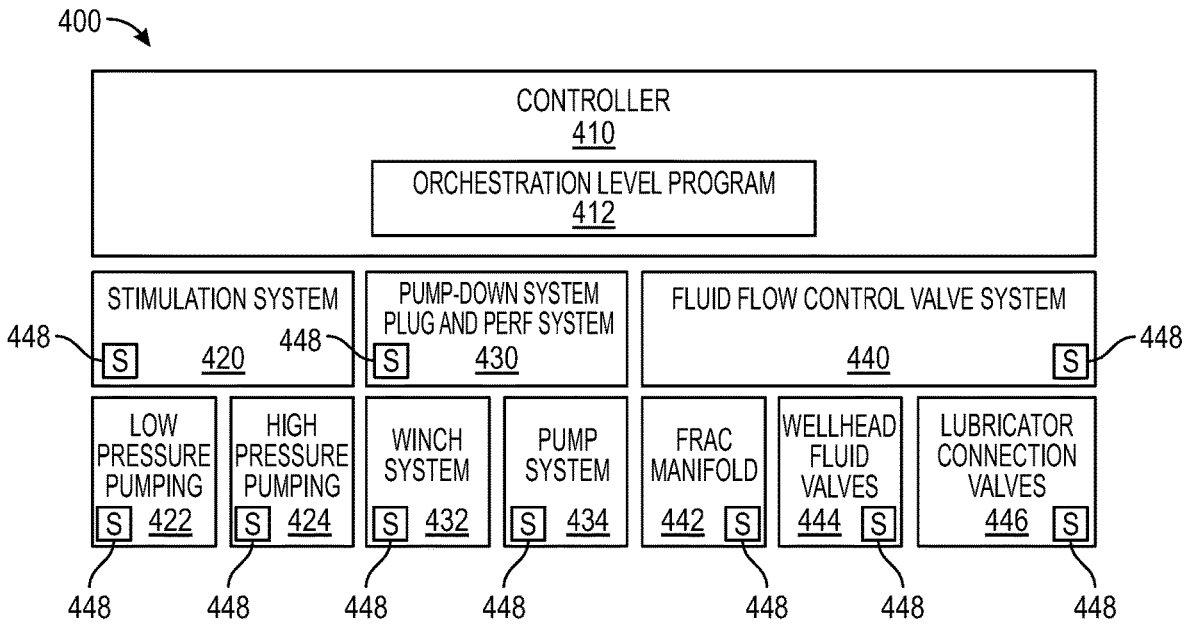
FIG. 4 is a schematic view of at least a portion of a control system, in accordance with embodiments of the present disclosure.

FIG. 4 is a schematic view of at least a portion of a control system 400, in accordance with embodiments of the present disclosure. As illustrated, in certain embodiments, the control system 400 may include a controller 410 storing and executing an orchestration level program 412 according to one or more aspects of the present disclosure. The controller 410 may be, include, or form a portion of one or more of the controllers 161, 212, 252, 262, 272, 312 described herein. The controller 410 may monitor and control different equipment of the wellsite systems 100, 200, 300 and, thus, control the associated well services performed by such equipment in a coordinated manner, as described in greater detail herein. Indeed, in certain embodiments, the controller 410 may control any and all operations of any and all of the equipment described herein based at least in part on feedback from sensors relating to any and all of the operational parameters described herein such that all of the well services described herein may be performed in a coordinated manner, as described in greater detail herein.

For example, in certain embodiments, the controller 410 may monitor and control a stimulation system 420 or another treatment fluid system configured to perform stimulation (e.g., hydraulic fracturing) or other fluid treatment operations of one or more wellbores 102. The stimulation system 420 may be, include, or form at least a portion of the treatment fluid system described herein. Thus, the controller 410 may control low-pressure treatment fluid pumping 422 performed by various pumping equipment 110, 109, 112, 124, 126 of the treatment fluid system and high-pressure stimulation pumping 424 performed by the pumping units 150 of the treatment fluid system. In certain embodiments, the controller 410 may be communicatively connected to one or more local controllers (e.g., controller 252) of the stimulation system to control the stimulation system 420.

In certain embodiments, the controller 410 may further monitor and control a pump-down system and a plug and perf system 430, each configured to perform pump-down operations and plug and perf operations, respectively. In certain embodiments, the controller 410 may control a winch system 432 (e.g., the winch device 184, the conveyance device 210, the injection head 324, and the line storage device 310) and a pump system 434 (e.g., pump unit 190 and fluid container 194). In certain embodiments, the controller 410 may be communicatively connected to one or more local controllers (e.g., the controller 212, 262, 312) of the pump-down system and the plug and perf system 430.

In certain embodiments, the controller 410 may also monitor and control a fluid flow control valve system 440 configured to fluidly connect the stimulation system 420 to selected one or more of the wellbores 102 during the stimulation operations and to fluidly connect the pump-down system 430 to a selected wellbore 102 during the pump-down operations. In certain embodiments, the controller 410 may control different portions of the fluid flow control valve system 440, such as a fracturing manifold 442 (e.g., the fracturing manifold 170), wellhead fluid flow control valves 444 (e.g., the fluid flow control valves 204, 206, the access valve 208), and lubricator connection valves 446.

In certain embodiments, the controller 410 executing the orchestration level program 412 may be configured to provide monitoring and coordinated control to the stimulation operations performed by the stimulation system 420, the pump-down and plug and perf operations performed by the pump-down and plug and perf systems 430, and the fluid flow control valve operations performed by the wellhead fluid flow control valve system 440. The controller 410 executing the orchestration level program 412 may be configured to implement optimal (e.g., most efficient) wellsite equipment coordination across the well services 420, 430, 440, with the goal of performing continuous pumping downhole. The controller 410 executing the orchestration level program 412 may be further configured to minimize time between pumping stages and to increase personnel safety, such as by forbidding wellsite personnel to enter high-pressure areas of the wellsite systems 100, 200, 300.

The controller 410 executing the orchestration level program 412 may be configured to communicate directly with the wellsite equipment to cause performance of the well services 420, 430, 440, communicate indirectly with the wellsite equipment via local controllers to cause performance of the well services 420, 430, 440, and to coordinate individual operations of the wellsite equipment to implement the well services 420, 430, 440. For example, after stimulation is completed on one wellbore 102, the controller 410 executing the orchestration level program 412 will know the well service status of the next wellbore 102. If the next wellbore 102 is ready for stimulation operations, the controller 410 executing the orchestration level program 412 may operate (i.e., open) the corresponding fluid access valve 204 and cause the stimulation system 420 and the fluid flow control valve system 440 to operate to inject the treatment fluid (e.g., fracturing fluid) into the next wellbore 102. The controller 410 executing the orchestration level program 412 may have visibility to a current status of wellsite operations and a future completion plan. The ability to look ahead may ensure that automation sequencing is operable to keep up with the planned completion strategy.

In certain embodiments, the controller 410 executing the orchestration level program 412 may provide coordination across multiple wellbores, such as by tracking operational status of stimulation operations performed by the stimulation system 420, operational status of the pump-down operations performed by the pump-down system 430, the downhole position of the tool string 180 including the perforating tool 234, and valve positions of the fluid flow control valve system 440. In certain embodiments, the controller 410 may further provide control commands to the well services 420, 430, 440, including orchestrating opening and closing of the wellhead fluid control valves 444 (e.g., fluid flow control valves 206) based at least in part on the stimulation crew progress or readiness and causing pump-down operations to commence when corresponding wellhead fluid control valves 444 are open when the perforating tool 234 is to be deployed downhole. In certain embodiments, the controller 410 executing the orchestration level program 412 may be configured to determine future events (e.g., look-ahead forecasting) based at least in part on monitored current operational status and a planned (i.e., future) job schedule. In certain embodiments, the controller 410 may provide the ability to manage workflow and maintenance activities based at least in part on the completion forecast, maintenance cycles, and real-time operational status of the wellsite equipment.

In certain embodiments, the controller 410 executing the orchestration level program 412 may be communicatively connected to the stimulation system 420, the pump system 434, the winch system 432, the flow control wellhead valve system 440 (e.g., the fracturing manifold 170, the fluid flow control devices 174, 176, the sealing and alignment assembly 189, and a valve for introducing lubricant into the lubricator 220). In certain embodiments, the controller 410 may be further communicatively connected to a crane or pipe handling equipment configured to move the sealing and alignment assembly 189 from wellbore 102 to wellbore 102 when a different wellbore 102 is to be plugged and perforated. In certain embodiments, the controller 410 may coordinate automation control commands to inform sub-services of the timing of each operation at the wellsite 104. In certain embodiments, the controller 410 may automatically coordinate a well swap process, such as by automatically opening and closing flow control wellhead valves 444, pressure testing, bleeding off pressure, and providing safety interlocks. In certain embodiments, the controller 410 may be configured to maintain a completion strategy (e.g., order) by determining which wellbore 102 is to be completed and orchestrating movement to the next intended wellbore 102 in the plan. In certain embodiments, the controller 410 may align maintenance cycles across the well services based at least in part on each individual service cycles, the current equipment status, and the look-ahead forecasting for optimal completion strategy.

In certain embodiments, the controller 410 executing the orchestration level program 412 may be configured to look ahead to coordinate preventive maintenance events or cycles that are planned to be performed across the well services. In certain embodiments, the controller 410 may be configured to determine optimal time to disrupt the continuous pumping operations to perform the maintenance events. In certain embodiments, the optimal time to perform the maintenance events may be determined such that a maximum number of consecutive pumping stages are performed and a minimum amount of down time is utilized for performing such maintenance events across the well services 420, 430, 440. In certain embodiments, the controller 410 may receive information indicative of the maintenance events, keep track of the maintenance events being performed on the equipment across the well services 420, 430, 440, determine how much operational time a piece of equipment has left, forecast which equipment will need maintenance prior to the next job, and have access to wellsite equipment maintenance systems and schedules, such as may permit the controller 410 to track the status of the maintenance events in real-time.

In certain embodiments, the controller 410 executing the orchestration level program 412 may be further configured to define an optimal logistics plan for scheduling deliveries of wellsite materials, personnel, and equipment. In certain embodiments, the controller 410 may be configured to generate or otherwise define an optimal work instruction schedule for wellsite personnel (e.g., wellsite operators 164, 214, 254, 264, 274, maintenance personnel, material control personnel, etc.) that is tailored to the well services 420, 430, 440 performed at the wellsite and configured to facilitate multi-skilling and optimal wellsite personnel utilization. In certain embodiments, the controller 410 may have domain knowledge and/or sequences to inform each well service system 420, 430, 440 of the proper operating steps that are dependent on the other well services 420, 430, 440. In certain embodiments, the controller 410 may communicate with each well service system 420, 430, 440 to track the progress of each well service and continually update the plan for subsequent to manage the entire workflow, distributing execution plans to each system 420, 430, 440.

For example, the controller 410 executing the orchestration level program 412 may be configured to track consumption of wellsite material (e.g., water, hydratable material, proppant, chemicals, etc.) and equipment use, determine future material consumption and equipment use based at least in part on the defined work instruction schedule and on the tracked consumption and use, and plan material deliveries based at least in part on the determined future consumption and use to maintain optimal supply of material and equipment at the wellsite to facilitate continuous performance of the well services 420, 430, 440 in the near future (e.g., 12, 24, 36, 48, or more hours). In certain embodiments, the controller 410 may have access to material shipment tracking and integrated bill of landing information to automatically track and determine material inventories at the wellsite 104 and material quantities in transit. For example, the controller 410 may have access to material mass balances and track material consumption at the wellsite via densitometer readings. In addition, in certain embodiments, the controller 410 may have access to equipment tracking systems to provide physical location of wellsite equipment and materials being transported to the wellsite 104. In certain embodiments, individual equipment trackers (e.g., transceivers) may interface with sensors for measuring level and/or volumes of liquid chemicals and/or other liquid materials being transported to the wellsite. Such data may be received by the controller 410 for automated consumption and delivery tracking. The controller 410 may, thus, determine liquid material levels at the wellsite 104 during the job and report levels that are moved off the wellsite 104 for refilling or when dispatched to another pad.

In certain embodiments, the controller 410 executing the orchestration level program 412 may also have access to personnel tracking (e.g., actual location at the wellsite, hours spent at the location) and competency tracking information to automatically track physical location of wellsite personnel, such as based at least in part on wearable devices or image recognition. In certain embodiments, the controller 410 may utilize the tracking information to automatically populate business systems for payroll and update competency records, such as based at least in part on hours running specific equipment. In certain embodiments, the controller 410 may also utilize the tracking information to provide insight on standard work instructions to track and update time for completion of certain tasks. In certain embodiments, the controller 410 may determine if multi-skilling and overall crew reduction can be implemented based at least in part on personnel tracking information and competency information.

In certain embodiments, the orchestration level program 412 may implement or otherwise utilize artificial intelligence job planning and execution, which may permit the orchestration level program to plan, execute, and re-plan the stimulation (e.g., perforating) operations, the pump-down operations, the conveyance operations, the plug and perf operations, and operations of the fluid flow control valves, in real-time. In certain embodiments, the orchestration level program 412 may be or include, for example, an optimizer schedule or an artificial intelligence planning engine. In certain embodiments, the orchestration level program 412 may be installed or otherwise imparted onto a coordinated controller 410 (e.g., the controller 272, stimulation van acquisition framework), which may implement (i.e., execute) the orchestration level program 412. In certain embodiments, the orchestration level program 412 may be executed from a fluid treatment monitoring and control trailer (e.g., the control center 250).

In certain embodiments, the coordinated controller 410 may receive sensor data from various sensors 448 disposed in and around the various equipment of the wellsite system 100 described herein, and may use the received sensor data to coordinate the operations of the various systems using the orchestration level program 412. For example, in certain embodiments, one or more of the systems 420, 422, 424, 430, 432, 434, 440, 442, 444, 446 of the wellsite system 100 may each include one or more sensors 448 configured to monitor various operational parameters of the respective systems 420, 422, 424, 430, 432, 434, 440, 442, 444, 446, and the orchestration level program 412 of the coordinated controller 410 may use the monitored operational parameters to determine how to coordinate the operations of the systems 420, 422, 424, 430, 432, 434, 440, 442, 444, 446.

For example, in certain embodiments, the pump rates of the pump units 150, 190 at the surface of the wellsite 104 may be monitored by one or more sensors 448, and these pump rates may be used by the orchestration level program 412 of the coordinated controller 410 to control other parameters of the other systems of the wellsite system 100. In addition, in certain embodiments, pressures, temperatures, and/or flow rates of the fluids exiting the pump units 150, 190 may be monitored by one or more sensors 448 of the pump units 150, 190 at the surface of the wellsite 104, and these pressures, temperatures, and/or flow rates may be used by the orchestration level program 412 of the coordinated controller 410 to control other parameters of the other systems of the wellsite system 100. In addition, in certain embodiments, downhole pressures, temperatures, and/or flow rates of the fluids being delivered downhole through a wellbore 102 may be monitored by one or more sensors 448 of the downhole tool string 180, and these pressures, temperatures, and/or flow rates may be used by the orchestration level program 412 of the coordinated controller 410 to control other parameters of the other systems of the wellsite system 100. In addition, in certain embodiments, a downhole tension and/or a downhole speed at the cable head 230 of the downhole tool string 180 may be monitored by one or more sensors 448 of the downhole tool string 180, and this downhole tension and/or downhole speed may be used by the orchestration level program 412 of the coordinated controller 410 to control other parameters of the other systems of the wellsite system 100. It will be appreciated that, in certain embodiments, the downhole measurements collected by the sensors 448 of the downhole tool string 180 may be communicated to the controller 410 via a communication cable or thread of the conveyance line 182, for example.

As described in greater detail herein, each of the operational parameters that are monitored by the sensors 448 described herein may be used by the orchestration level program 412 of the coordinated controller 410 to control other parameters of the other systems of the wellsite system 100. For example, in certain embodiments, pump rates of the pump units 150, 190 described herein may be adjusted (e.g., increased or decreased) by the orchestration level program 412 of the coordinated controller 410 based at least in part on the downhole tension at the cable head 230 of the downhole tool string 180 so as to optimize the pump-down time. In addition, in certain embodiments, the pressure of the fluids (e.g., at the surface of the wellsite 104 and/or downhole proximate the downhole tool string 180) may also be used by the orchestration level program 412 of the coordinated controller 410 to control the pump rates of the pump units 150, 190 described herein. In addition, in certain embodiments, the pressure of the fluids (e.g., at the surface of the wellsite 104 and/or downhole proximate the downhole tool string 180) may be used by the orchestration level program 412 of the coordinated controller 410 to monitor and/or confirm rates of change in the downhole tension at the cable head 230 of the downhole tool string 180. Furthermore, in certain embodiments, the orchestration level program 412 of the coordinated controller 410 may compare differences between the surface pressures and the downhole pressures to determine fluid weight and/or to approximate the depth of the downhole tool string 180.

The embodiments described herein also enable various levels of automation of the orchestration of the operational parameters of the equipment of the wellsite system 100. In general, each of the levels described herein extends the automation functionality of the next lower level. At Level 1, the orchestration level program 412 of the coordinated controller 410 provides data relating to the operational parameters of the wellsite system 100 described herein to a wellsite operator 164, for example, via an output device 166 to allow the wellsite operator to determine whether a particular operational parameter is within an acceptable operating range.

At Level 2, the orchestration level program 412 of the coordinated controller 410 additionally provides an alarm to the wellsite operator 164, for example, via an output device 166 to indicate that some predefined limit (e.g., which could be automatically set based upon contextual information, for example, relating to the downhole tool string 180) for a particular operational parameter has been reached.

At Level 3, the orchestration level program 412 of the coordinated controller 410 provides an alarm to the wellsite operator 164, for example, via an output device 166 based at least in part on a comparison of one or more operational parameters versus a previous pump-down operation (or even a simulated pump-down operation). For example, if a significant deviation occurs between one or more operational parameters, then the alarm may be provided.

At Level 4, the orchestration level program 412 of the coordinated controller 410 provides an alarm and recommends to the wellsite operator 164, for example, via an output device 166 to manually adjust an operational parameter of the wellsite system 100 (e.g., "Stop Pumping—The wireline cable is about to break!").

At Level 5, the orchestration level program 412 of the coordinated controller 410 provides an alarm and a prompt to the wellsite operator 164, for example, via an output device 166 whether it can automatically adjust an operational parameter of the wellsite system 100 (e.g., "The wireline cable is about to Break! Do you want me to stop the pumps? Yes/No"). If accepted by the wellsite operator 164, the recommendation for certain set points may be sent by the orchestration level program 412 of the coordinated controller 410 sent to certain pump units 150, 190 to disengage the transmission, for example, of the pump units 150, 190.

At Level 6, the orchestration level program 412 of the coordinated controller 410 provides an alarm and alerts the wellsite operator 164, for example, via an output device 166 that it is going to automatically adjust an operational parameter of the wellsite system 100 unless the wellsite operator 164 declines (e.g., "The Wireline cable is about to break! I am stopping the pumps in 3 seconds unless you stop me! 3-2-1. Pumps disengaged." The wellsite operator 164 may override the automation, but if the wellsite operator 164 ignores the alert for a certain amount of time, the orchestration level program 412 automatically implements the control command.

At Level 7, the orchestration level program 412 of the coordinated controller 410 provides an alarm and alerts the wellsite operator 164, for example, via an output device 166 that it has already automatically adjusted an operational parameter of the wellsite system 100 (e.g., stopped pumping because the head tension is too high: "The head tension reached the maximum limit. I have stopped the pumps." In this instance, the wellsite operator 164 cannot override the automation, but the wellsite operator 164 may try to manually control the equipment of the wellsite system 100 to attempt to remedy the situation afterwards.

At Level 8, as part of a larger automation system, after the pump-down operations have been commenced, the orchestration level program 412 of the coordinated controller 410 monitors the operational parameters, as described herein, while the pump-down operations are automatically performed under the control of the orchestration level program 412. Assuming no operational alerts are raised by the orchestration level program 412, the entire pump-down job may be completed, and the wellsite operator 164 may be provided with feedback, for example, via an output device 166 on the success of the job. As such, no wellsite operator 164 is required unless there is some sort of alert raised. In the event of an alert being raised, the orchestration level program 412 may stop the equipment of the wellsite system 100 and alert a wellsite operator that some intervention is requested.

At Level 9, the orchestration level program 412 of the coordinated controller 410 may automatically resolve any alerts that would otherwise be raised by, for example, retrieving the downhole tool string 180 and notifying a wellsite operator 164 that the pump-down operations were not successful.

At Level 10, the entire pump-down operations may be at least partially automated. For example, even the equipment of the wellsite system 100 may be moved into place under control of the orchestration level program 412 of the coordinated controller 410. As an example, a fully unmanned wireline truck 218 may be moved into position by the orchestration level program 412, the pump units 150, 190 may be connected, and a wellsite operator 164 may simply press a start button once the equipment of the wellsite system 100 are "digitally" ready to perform the pump-down operations. In certain embodiments, the orchestration level program 412 may place the guns of the perforating tool 234 in the correct locations, and cause them to fire, using a planned perforation plan. After a given amount of time (e.g., about 40 minutes), the orchestration level program 412 may send a text message (e.g., a short message service (SMS) message) to a wellsite operator 164 that, for example, the client has been notified (e.g., again, via a text message, for example) of the successful pump-down job, and/or that the guns of the perforating tool 234 will be ready to be changed in a certain amount of time (e.g., 10 minutes) as the orchestration level program 412 finishes causing the downhole tool string 180 to be retrieved.

In certain embodiments, if the downhole tension at the cable head 230 of the downhole tool string 180 is rising unexpectedly (e.g., as computed by the orchestration level program 412 of the coordinated controller 410 using something like a change-point detector), the orchestration level program 412 may trigger an automation action, such as stopping or slowing the pump units 150, 190. With the addition of previous pump-down perforating data, the tracking of depth vs. tension and pump rate and/or pressure may be used by the orchestration level program 412 to provide an indication that the pump-down is not following previous trends at the same depths. This may potentially indicate some unexpected behavior is occurring that may be an early warning sign of an obstruction in the well (e.g., possibly sand from the previous fracturing operations).

Automation of the pump-down perforating operations could also encompass the client and the full planned completion schedule. This expanded role allows the orchestration level program 412 of the coordinated controller 410 to notify the client and automate reporting of data to the client about, for example, the rate of progress of a pump-down perforating job being performed, an expected time of completion of the pump-down perforating job being performed, gun positions, and any potential problems or text messages from the equipment of the wellsite system 100. Using the planned completion schedule, the orchestration level program 412 may be able to monitor if the pump-down perforating operations are ahead of schedule or behind schedule, and could apply risk management to optimize the job by, for example, pumping faster to try to catch up (e.g., at the risk of wireline separation) or pump more slowly and carefully to position the downhole tool string 180 more accurately and perhaps acquire overall pressure changes to a previously perforated formation.

By providing the pump-down perforating data about the organization, well, stage number, depth, and so forth, more automation of the pump-down perforating operations may be performed by the orchestration level program 412 of the coordinated controller 410. These include, but are not limited to, (1) automated, secure data transmission to the client into the correct organizational context, (2) automated gun placement and, potentially, their firing, (3) notification to automated frac-trees of the pump-down perforating status (e.g., starting—pumping firing—pulling out of hole—finished), (4) notification to personnel on-wellsite or off-wellsite of potential issues, (5) automated report generation and notification to the client, (6) automated pump-down perforating data archival of pump-down perforating operations with correct contextualization into the archival system, (7) automated pump-down perforating job report generation and client notification, (8) automated pump-down perforating completion notification and signaling to generate invoice, (9) automated notification to operations trucks of pump-down perforating status, and (10) automated generation of wellbore geometry for use in perforating gun placement information.

In addition to the automation of the tasks and notifications, in certain embodiments, the orchestration level program 412 of the coordinated controller 410 may utilize advanced algorithms to monitor the pressure response to the pump-down operations to provide some indication of the previous stimulation perforation's ability to accept fluid. This could indicate potential flow back issues, and even potentially damage due to the current pump-down activity—potentially stopping the pump-down perforating job—but saving the previous stimulation treatment.

Figure 5:
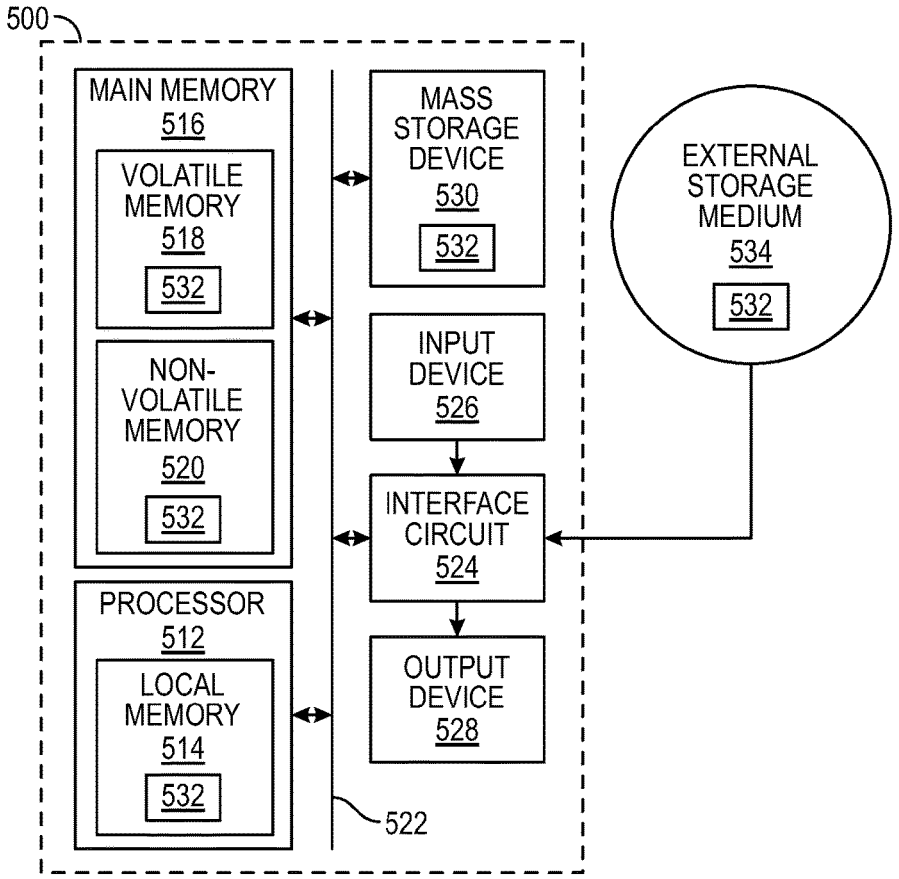
FIG. 5 is a schematic view of at least a portion of a processing device (or system), in accordance with embodiments of the present disclosure.

FIG. 5 is a schematic view of at least a portion of a processing device 500 (or system), in accordance with embodiments of the present disclosure. The processing device 500 may be or form at least a portion of one or more processing devices, equipment controllers, and/or other electronic devices shown in one or more of the FIGS. 1-4. Accordingly, the following description refers to FIGS. 1-5, collectively.

In certain embodiments, the processing device 500 may be or include, for example, one or more processors, controllers, special-purpose computing devices, personal computers (PCs, e.g., desktop, laptop, and/or tablet computers), personal digital assistants, smartphones, industrial PCs (IPCs), PLCs, servers, internet appliances, and/or other types of computing devices. In certain embodiments, the processing device 500 may be or form at least a portion of the controllers 161, 212, 252, 262, 272, 312, 410 shown in FIGS. 1-4 and/or local controllers associated with one or more instances of the wellsite equipment shown in FIGS. 1-4. Although it is possible that the entirety of the processing device 500 is implemented within one device, it is also contemplated that one or more components or functions of the processing device 500 may be implemented across multiple devices, some or an entirety of which may be at the wellsite and/or remote from the wellsite.

The processing device 500 may include a processor 512, such as a general-purpose programmable processor. The processor 512 may include a local memory 514, and may execute machine-readable and executable program code instructions 532 (i.e., computer program code) present in the local memory 514 and/or another memory device. The processor 512 may execute, among other things, the program code instructions 532 and/or other instructions and/or programs to implement the example methods, processes, and/or operations described herein. For example, the program code instructions 532, when executed by the processor 512 of the processing device 500, may cause the equipment described herein to perform example methods and/or operations described herein. The program code instructions 532, when executed by the processor 512 of the processing device 500, may also or instead cause the processor 512 to receive and process sensor data (e.g., sensor measurements), and output control commands to the wellsite equipment based at least in part on programming, predetermined setpoints, and the received sensor data.

The processor 512 may be, include, or be implemented by one or more processors of various types suitable to the local application environment, and may include one or more of general-purpose computers, special-purpose computers, microprocessors, digital signal processors (DSPs), field-programmable gate arrays (FPGAs), application-specific integrated circuits (ASICs), and processors based at least in part on a multi-core processor architecture, as non-limiting examples. Examples of the processor 512 include one or more INTEL microprocessors, microcontrollers from the ARM and/or PICO families of microcontrollers, and embedded soft/hard processors in one or more FPGAs.

In certain embodiments, the processor 512 may be in communication with a main memory 516, such as may include a volatile memory 518 and a non-volatile memory 520, perhaps via a bus 522 and/or other communication means. In certain embodiments, the volatile memory 518 may be, include, or be implemented by random-access memory (RAM), static RAM (SRAM), synchronous dynamic RAM (SDRAM), dynamic RAM (DRAM), RAM- BUS dynamic RAM (RDRAM), and/or other types of RAM devices. In certain embodiments, the non-volatile memory 520 may be, include, or be implemented by read-only memory, flash memory, and/or other types of memory devices. One or more memory controllers (not shown) may control access to the volatile memory 518 and/or non-volatile memory 520.

In certain embodiments, the processing device 500 may also include an interface circuit 524, which is in communication with the processor 512, such as via the bus 522. In certain embodiments, the interface circuit 524 may be, include, or be implemented by various types of standard interfaces, such as an Ethernet interface, a universal serial bus (USB), a third generation input/output (3GIO) interface, a wireless interface, a cellular interface, and/or a satellite interface, among others. In certain embodiments, the interface circuit 524 may include a graphics driver card. In certain embodiments, the interface circuit 524 may include a communication device, such as a modem or network interface card to facilitate exchange of data with external computing devices via a network (e.g., Ethernet connection, digital subscriber line (DSL), telephone line, coaxial cable, cellular telephone system, satellite, etc.).

In certain embodiments, the processing device 500 may be in communication with various sensors, video cameras, actuators, processing devices, equipment controllers, and other devices of the wellsite systems 100, 200, 300 via the interface circuit 524. The interface circuit 524 may facilitate communications between the processing device 500 and one or more devices by utilizing one or more communication protocols, such as an Ethernet-based network protocol (e.g., ProfiNET, OPC, OPC/UA, Modbus TCP/IP, EtherCAT, UDP multicast, Siemens S7 communication, or the like), a proprietary communication protocol, and/or another communication protocol.

In certain embodiments, one or more input devices 526 may also be connected to the interface circuit 524. The input devices 526 may permit human wellsite operators 164 to enter the program code instructions 532, which may be or include control commands, operational parameters, operational thresholds, and/or other operational set-points. The program code instructions 532 may further include modeling or predictive routines, equations, algorithms, processes, applications, orchestration level programs, and/or other programs configured to perform example methods and/or operations described herein. In certain embodiments, the input devices 526 may be, include, or be implemented by a keyboard, a mouse, a joystick, a touchscreen, a track-pad, a trackball, an isopoint, and/or a voice recognition system, among other examples.

In certain embodiments, one or more output devices 528 may also be connected to the interface circuit 524. The output devices 528 may permit visualization or other sensory perception of various data, such as sensor data, status data, and/or other example data. In certain embodiments, the output devices 528 may be, include, or be implemented by video output devices (e.g., a liquid crystal display (LCD), a light-emitting diode (LED) display, a cathode-ray tube (CRT) display, a touchscreen, etc.), printers, and/or speakers, among other examples. In certain embodiments, the one or more input devices 526 and the one or more output devices 528 connected to the interface circuit 524 may, at least in part, facilitate the HMIs described herein.

In certain embodiments, the processing device 500 may include a mass storage device 530 for storing data and program code instructions 532. The mass storage device 530 may be connected to the processor 512, such as via the bus 522. In certain embodiments, the mass storage device 530 may be or include a tangible, non-transitory storage medium, such as a floppy disk drive, a hard disk drive, a compact disk (CD) drive, and/or digital versatile disk (DVD) drive, among other examples. The processing device 500 may be communicatively connected to an external storage medium 534 via the interface circuit 524. In certain embodiments, the external storage medium 534 may be or include a removable storage medium (e.g., a CD, DVD, or flash disk drive), such as may be configured to store data and program code instructions 532.

As described herein, the program code instructions 532 and other data (e.g., sensor data or measurements database) may be stored in the mass storage device 530, the main memory 516, the local memory 514, and/or the removable storage medium 534. Thus, the processing device 500 may be implemented in accordance with hardware (perhaps implemented in one or more chips including an integrated circuit, such as an ASIC), or may be implemented as software or firmware for execution by the processor 512. In the case of firmware or software, the implementation may be provided as a computer program product including a non-transitory, computer-readable medium or storage structure embodying computer program code instructions 532 (i.e., software or firmware) thereon for execution by the processor 512. The program code instructions 532 may include program instructions or computer program code that, when executed by the processor 512, may perform and/or cause performance of example methods, processes, and/or operations described herein.

Figure 7:
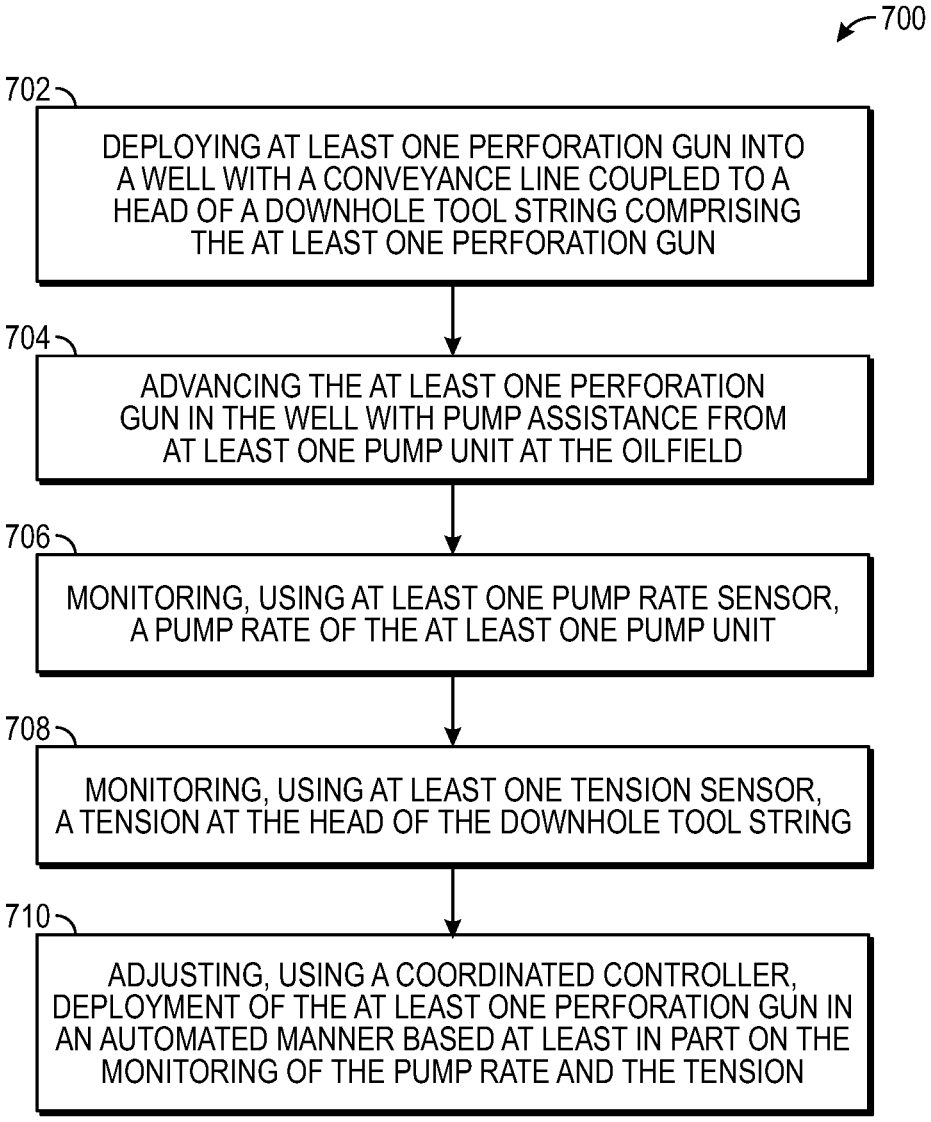
FIG. 7 is a block diagram of a method for automating perforation gun deployment to a downhole location in a well at an oilfield, in accordance with embodiments of the present disclosure.

FIG. 7 is a block diagram of a method 700 for automating perforation gun deployment to a downhole location in a well at an oilfield, in accordance with embodiments of the present disclosure. As illustrated in FIG. 7, in certain embodiments, the method 700 includes deploying at least one perforation gun 234 into the well with a conveyance line 211, 311 coupled to a head 230 of a downhole tool string 180 that includes the at least one perforation gun 234 (block 702). The method 700 also includes advancing the at least one perforation gun 234 in the well with pump assistance from at least one pump unit 150, 190 at the oilfield (block 704). The method 700 further includes monitoring, using at least one pump rate sensor 448, a pump rate of the at least one pump unit 150, 190 at the oilfield (block 706). In addition, the method 700 includes monitoring, using at least one tension sensor 448, a tension at the head 230 of the downhole tool string 180 (block 708). The method 700 also includes adjusting, using a coordinated controller 161, 212, 252, 262, 272, 312, 410 (e.g., as illustrated in FIGS. 1-4, and generally having at least the components described with respect to the processing device 500 illustrated in FIG. 5), deployment of the at least one perforation gun 234 in an automated manner based at least in part on the monitoring of the pump rate and the tension (block 710).

In certain embodiments, the method 700 may also include monitoring, using at least one downhole pressure sensor 448 of the downhole tool string 180, a downhole pressure of a fluid 242 surrounding the downhole tool string 180 in the well; and adjusting, using the coordinated controller, the deployment of the at least one perforation gun 234 in the automated manner based at least in part on the monitoring of the downhole pressure.

In addition, in certain embodiments, the method 700 may also include monitoring, using at least one downhole speed sensor 448 of the downhole tool string 180, a downhole speed of the downhole tool string 180 through the well; and adjusting, using the coordinated controller, the deployment of the at least one perforation gun 234 in the automated manner based at least in part on the monitoring of the downhole speed.

In addition, in certain embodiments, the method 700 may also include monitoring, using at least one surface pressure sensor 448, a surface pressure of a fluid exiting the at least one pump unit 150, 190; and adjusting, using the coordinated controller, the deployment of the at least one perforation gun 234 in the automated manner based at least in part on the monitoring of the surface pressure.

In addition, in certain embodiments, the method 700 may also include determining, using the coordinated controller, a rate of change in the tension at the head 230 of the downhole tool string 180; and adjusting, using the coordinated controller, the deployment of the at least one perforation gun 234 in the automated manner based at least in part on the determined rate of change in the tension.

In addition, in certain embodiments, the method 700 may also include sending, using the coordinated controller, a text message in response to completion of a perforation job performed by the at least one perforation gun 234.

In addition, in certain embodiments, the method 700 may also include sending, using the coordinated controller, a text message in response to a determination that the at least one perforation gun 234 is ready to be changed.

In addition, in certain embodiments, the method 700 may also include reporting, using the coordinated controller, a rate of progress of a perforation job performed by the at least one perforation gun 234, an expected time of completion of the perforation job performed by the at least one perforation gun 234, a gun position of the at least one perforation gun 234, or some combination thereof.

The embodiments of the wellsite system 100 described herein also include: (A) a treatment fluid system, as described in greater detail herein, configured to pump a treatment fluid into a wellbore 102 extending into a subterranean formation 106 from a surface of an oil and gas wellsite 104; (B) a pump-down system, as described in greater detail herein, configured to pump a pump-down fluid into the wellbore 102 to convey a perforating tool 234 through the wellbore 102; (C) a fluid valve system, as described in greater detail herein, configured to selectively fluidly connect and disconnect the treatment fluid system and the pump-down system to and from the wellbore 102; and (D) a controller 161, 212, 252, 262, 272, 312, 410 (e.g., as illustrated in FIGS. 1-4, and generally having at least the components described with respect to the processing device 500 illustrated in FIG. 5) having a processor 512 and a memory 514, 516, 530, 534 storing computer program code 532, wherein the controller is communicatively connected to the treatment fluid system, the pump-down system, and the fluid valve system, and wherein the controller is configured to: (i) monitor operational status of the treatment fluid system, the pump-down system, and the fluid valve system; and (ii) control operations of the treatment fluid system, the pump-down system, and the fluid valve system based at least in part on the operational status of the treatment fluid system, the pump-down system, and the fluid valve system.

In certain embodiments, the treatment fluid may be or include a fracturing fluid, and the treatment fluid system may be or include a fracturing fluid mixing and pumping system for facilitating well fracturing operations.

In addition, in certain embodiments, the pump-down system may include a pump 150, 190 and a container 112, 126, 194 storing the pump-down fluid, and the pump-down system may be configured to pump the pump-down fluid into the wellbore 102 to convey the perforating tool 234 downhole through the wellbore 102 when the fluid valve system fluidly connects the pump-down system to the wellbore 102. In certain embodiments, the wellsite system 100 also includes a perforating system having: the perforating tool 234 for perforating the wellbore 102; a conveyance line 182, 211, 311 connected to the perforating tool 234; and a conveyance system 184, 210, 310 for reeling the conveyance line 182, 211, 311 to convey the perforating tool 234 through the wellbore 102.

In addition, in certain embodiments, the fluid valve system may include: a first fluid control valve fluidly connected between the treatment fluid system and the wellbore 102, wherein the first fluid control valve may be configured to selectively fluidly connect and disconnect the treatment fluid system and the wellbore 102, and wherein the first fluid control valve may be connected to a wellhead 178 associated with the wellbore 102; and a second fluid control valve fluidly connected between the pump-down system and the wellbore 102, wherein the second fluid control valve may be configured to selectively fluidly connect and disconnect the pump-down system and the wellbore 102, and wherein the second fluid control valve may be connected to the wellhead 178. The fluid valve system may further include a fracturing manifold 170, 442 fluidly connected between the treatment fluid system and the wellbore 102, and the fracturing manifold 170, 442 may be configured to selectively fluidly connect and disconnect the treatment fluid system and the wellbore 102. In addition, in certain embodiments, the controller may be further configured to operate the fluid valve system to alternatingly connect and disconnect the treatment fluid system and the pump-down system to and from the wellbore 102.

In addition, in certain embodiments, the controller may be further configured to operate the fluid valve system to: open a first valve to fluidly connect the treatment fluid system to the wellbore 102 during well treatment operations; close a second valve to fluidly disconnect the pump-down system from the wellbore 102 during the well treatment operations; open the second valve to fluidly connect the pump-down system to the wellbore 102 during pump-down operations; and close the first valve to fluidly disconnect the treatment fluid system from the wellbore 102 during the pump-down operations.

In addition, in certain embodiments, the controller may be further configured to: (A) after the treatment fluid is pumped into the wellbore 102: (i) operate the fluid valve system to fluidly disconnect the treatment fluid system from the wellbore 102; (ii) operate the fluid valve system to fluidly connect the pump-down system to the wellbore 102; and (iii) operate the pump-down system to pump the pump-down fluid into the wellbore 102 to convey the perforating tool 234 through the wellbore 102; and (B) after the pump-down fluid is pumped into the wellbore 102 and the perforating tool 234 is retrieved from the wellbore 102: (i) operate the fluid valve system to fluidly disconnect the pump-down system from the wellbore 102; (ii) operate the fluid valve system to fluidly connect the treatment fluid system to the wellbore 102; and (iii) operate a treatment fluid pump of the treatment fluid system to pump the treatment fluid into the wellbore 102.

In addition, in certain embodiments, the wellbore 102 may be one of a plurality of wellbores 102, and the controller may be further configured to: monitor operational status of the treatment fluid system, the pump-down system, and the fluid valve system with respect to each wellbore 102; and control operations of the treatment fluid system, the pump-down system, and the fluid valve system with respect to each wellbore 102.

In addition, in certain embodiments, the wellbore 102 may be a first wellbore 102, the treatment fluid system may be further configured to pump the treatment fluid into a second wellbore 102 extending into the subterranean formation 106 from the surface of the oil and gas wellsite 104, the pump-down system may be further configured to pump the pump-down fluid into the second wellbore 102 to convey the perforating tool 234 within the second wellbore 102, the fluid valve system may be further configured to fluidly connect and disconnect the treatment fluid system and the pump-down system to and from the second wellbore 102, and the controller may be further configured to operate the fluid valve system to simultaneously: fluidly disconnect the pump-down system from the first wellbore 102; fluidly connect the treatment fluid system to the first wellbore 102 to permit pumping of the treatment fluid into the first wellbore 102; fluidly disconnect the treatment fluid system from the second wellbore 102; and fluidly connect the pump-down system to the second wellbore 102 to permit pumping of the pump-down fluid into the second wellbore 102 to convey the perforating tool 234 within the second wellbore 102.

The embodiments of the wellsite system 100 described herein also include: a treatment fluid system, as described in greater detail herein, configured to perform well treatment operations by pumping a treatment fluid into a wellbore 102 extending into a subterranean formation 106 from a surface of an oil and gas wellsite 104; a pump-down system, as described in greater detail herein, configured to perform pump-down operations by pumping a pump-down fluid into the wellbore 102 to convey a perforating tool 234 through the wellbore 102; a fluid valve system, as described in greater detail herein, configured to fluidly connect the treatment fluid system to the wellbore 102 during the well treatment operations and the pump-down system to the wellbore 102 during the pump-down operations; and a controller 161, 212, 252, 262, 272, 312, 410 (e.g., as illustrated in FIGS. 1-4, and generally having at least the components described with respect to the processing device 500 illustrated in FIG. 5) having a processor 512 and a memory 514, 516, 530, 534 storing computer program code 532. In certain embodiments, the controller is communicatively connected to the treatment fluid system, the pump-down system, and the fluid valve system. In certain embodiments, the controller is configured to, after the treatment fluid is pumped into the wellbore 102: operate the fluid valve system to fluidly disconnect the treatment fluid system from the wellbore 102; operate the fluid valve system to fluidly connect the pump-down system to the wellbore 102; and perform the pump-down operations by operating the pump-down system to pump the pump-down fluid into the wellbore 102 to convey the perforating tool 234 through the wellbore 102. In certain embodiments, the controller is also configured to, after the pump-down fluid is pumped into the wellbore 102 and the perforating tool 234 is retrieved from the wellbore 102: operate the fluid valve system to fluidly disconnect the pump-down system from the wellbore 102; operate the fluid valve system to fluidly connect the treatment fluid system to the wellbore 102; and perform the well treatment operations by operating the treatment fluid system to pump the treatment fluid into the wellbore 102.

In certain embodiments, the treatment fluid may be or include a fracturing fluid, and the treatment fluid system may be or include a fracturing fluid mixing and pumping system for facilitating well fracturing operations. In addition, in certain embodiments, the fluid valve system may further include a fracturing manifold 170, 442 fluidly connected between the treatment fluid system and the wellbore 102, and the fracturing manifold 170, 442 may be configured to selectively fluidly connect and disconnect the treatment fluid system and the wellbore 102.

In addition, in certain embodiments, the pump-down system may include a pump 150, 190 and a container 112, 126, 194 storing the pump-down fluid, and the pump-down system may be configured to pump the pump-down fluid into the wellbore 102 to convey the perforating tool 234 downhole through the wellbore 102 when the fluid valve system fluidly connects the pump-down system to the wellbore 102.

In addition, in certain embodiments, the wellbore 102 may be a first wellbore 102, the treatment fluid system may be further configured to pump the treatment fluid into a second wellbore 102 extending into the subterranean formation 106 from the surface of the oil and gas wellsite 104, the pump-down system may be further configured to pump the pump-down fluid into the second wellbore 102 to convey the perforating tool 234 within the second wellbore 102, the fluid valve system may be further configured to fluidly connect and disconnect the treatment fluid system and the pump-down system to and from the second wellbore 102, and the controller may be further configured to operate the fluid valve system to simultaneously: fluidly disconnect the pump-down system from the first wellbore 102; fluidly connect the treatment fluid system to the first wellbore 102 to permit pumping of the treatment fluid into the first wellbore 102; fluidly disconnect the treatment fluid system from the second wellbore 102; and fluidly connect the pump-down system to the second wellbore 102 to permit pumping of the pump-down fluid into the second wellbore 102 to convey the perforating tool 234 within the second wellbore 102.

The embodiments of the wellsite system 100 described herein also include: a treatment fluid system, as described in greater detail herein, configured to perform well treatment operations by pumping a treatment fluid into a first wellbore 102 or a second wellbore 102 extending into a subterranean formation 106 from a surface of an oil and gas wellsite 104; a pump-down system, as described in greater detail herein, configured to perform pump-down operations by pumping a pump-down fluid into the first wellbore 102 or the second wellbore 102 to convey a perforating tool 234 within the first wellbore 102 or the second wellbore 102; a fluid valve system, as described in greater detail herein, configured to fluidly connect and disconnect the treatment fluid system to and from the first wellbore 102 or the second wellbore 102 and to fluidly connect and disconnect the pump-down system to and from the first wellbore 102 or the second wellbore 102; and a controller 161, 212, 252, 262, 272, 312, 410 (e.g., as illustrated in FIGS. 1-4, and generally having at least the components described with respect to the processing device 500 illustrated in FIG. 5) having a processor 512 and a memory 514, 516, 530, 534 storing computer program code 532. In certain embodiments, the controller is communicatively connected to the treatment fluid system, the pump-down system, and the fluid valve system. In certain embodiments, the controller is configured to operate the fluid valve system to simultaneously: fluidly disconnect the pump-down system from the first wellbore 102; fluidly connect the treatment fluid system to the first wellbore 102 to permit pumping of the treatment fluid into the first wellbore 102; fluidly disconnect the treatment fluid system from the second wellbore 102; and fluidly connect the pump-down system to the second wellbore 102 to permit pumping of the pump-down fluid into the second wellbore 102 to convey the perforating tool 234 within the second wellbore 102.

In certain embodiments, the controller may be further configured to operate the fluid valve system to simultaneously: fluidly disconnect the pump-down system from the second wellbore 102; fluidly connect the treatment fluid system to the second wellbore 102 to permit pumping of the treatment fluid into the second wellbore 102; fluidly disconnect the treatment fluid system from the first wellbore 102; and fluidly connect the pump-down system to the first wellbore 102 to permit pumping of the pump-down fluid into the first wellbore 102 to convey the perforating tool 234 within the first wellbore 102.

In addition, in certain embodiments, the controller may be configured to: operate the fluid valve system to fluidly disconnect the treatment fluid system from the first wellbore 102 and fluidly connect the pump-down system to the first wellbore 102 after the perforating tool 234 is inserted into the first wellbore 102; operate the pump-down system to pump the pump-down fluid; stop operating the pump-down system to stop pumping the pump-down fluid; fluidly disconnect the pump-down system from the first wellbore 102 and fluidly connect the treatment fluid system to the first wellbore 102 after the perforating tool 234 is retrieved from the first wellbore 102; operate the treatment fluid system to pump the treatment fluid; stop operating the treatment fluid system to stop pumping the treatment fluid; fluidly disconnect the treatment fluid system from the second wellbore 102 and fluidly connect the pump-down system to the second wellbore 102 after the perforating tool 234 is inserted into the second wellbore 102; operate the pump-down system to pump the pump-down fluid; stop operating the pump-down system to stop pumping the pump-down fluid; fluidly disconnect the pump-down system from the second wellbore 102 and fluidly connect the treatment fluid system to the second wellbore 102 after the perforating tool 234 is retrieved from the second wellbore 102; operate the treatment fluid system to pump the treatment fluid; and stop operating the treatment fluid system to stop pumping the treatment fluid.

In addition, in certain embodiments, the treatment fluid may be or include a fracturing fluid, and the treatment fluid system may be or include a fracturing fluid mixing and pumping system for facilitating well fracturing operations.

Figure 8:
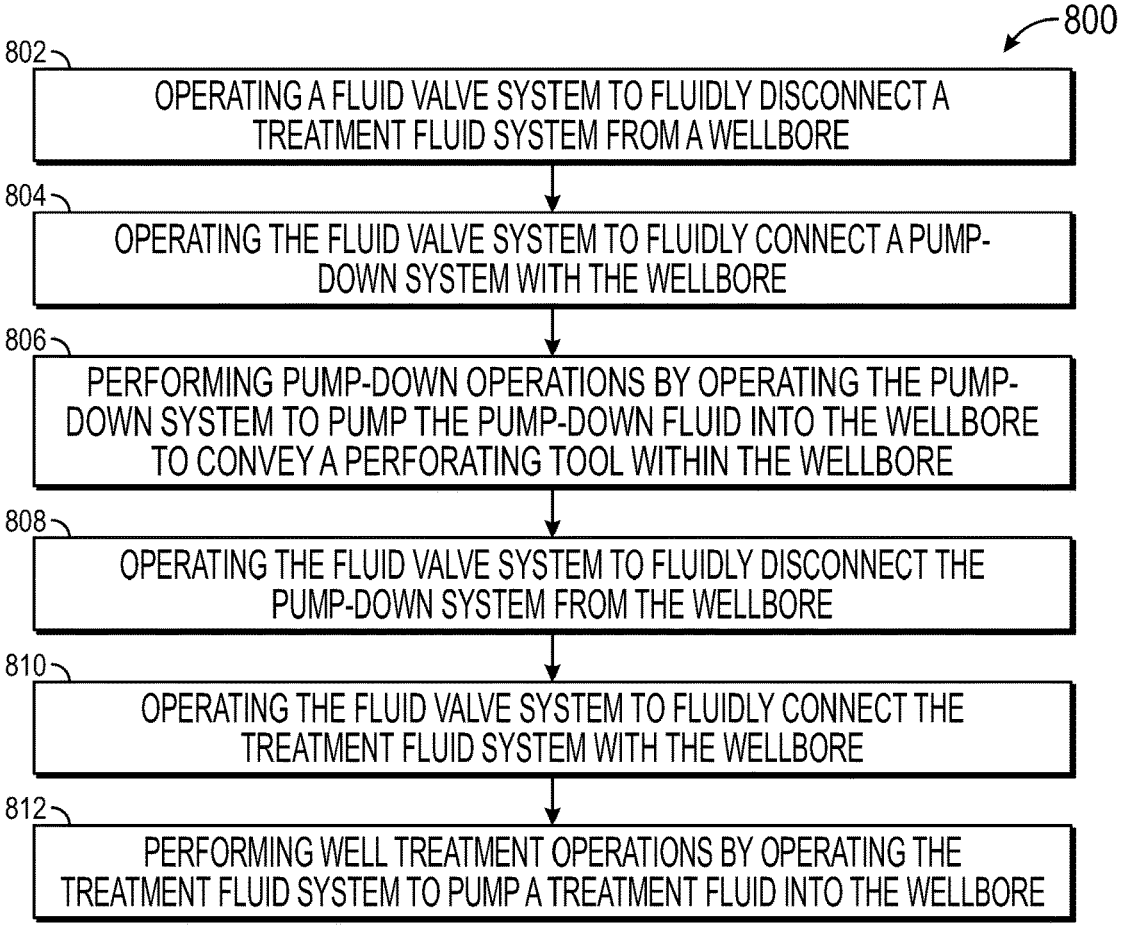
FIG. 8 is a block diagram of a method for coordinate pumping operations of a wellbore, in accordance with embodiments of the present disclosure.

FIG. 8 is a block diagram of a method 800 for coordinate pumping operations of a wellbore 102, in accordance with embodiments of the present disclosure. In certain embodiments, the method 800 may be performed by a controller 161, 212, 252, 262, 272, 312, 410 (e.g., as illustrated in FIGS. 1-4, and generally having at least the components described with respect to the processing device 500 illustrated in FIG. 5) configured to: (A) monitor operational status of a treatment fluid system, as described in greater detail herein, configured to pump a treatment fluid into a wellbore 102 extending into a subterranean formation 106 from a surface of an oil and gas wellsite 104, a pump-down system, as described in greater detail herein, configured to pump a pump-down fluid into the wellbore 102 to convey a perforating tool 234 through the wellbore 102, and a fluid valve system, as described in greater detail herein, configured to selectively fluidly connect and disconnect the treatment fluid system and the pump-down system to and from the wellbore 102; and (B) control operations of the treatment fluid system, the pump-down system, and the fluid valve system with respect to the wellbore 102. In particular, in certain embodiments, the controller may be configured to operate the fluid valve system to alternatingly connect and disconnect the treatment fluid system and the pump-down system to and from the wellbore 102. In certain embodiments, the treatment fluid may be or include a fracturing fluid, and the treatment fluid system may be or include a fracturing fluid mixing and pumping system for facilitating well fracturing operations.

For example, as illustrated in FIG. 8, in certain embodiments, the method 800 includes operating the fluid valve system to fluidly disconnect (e.g., by closing a valve) the treatment fluid system from the wellbore 102 (block 802), operating the fluid valve system to fluidly connect (e.g., by opening a valve) the pump-down system to the wellbore 102 (block 804), and performing pump-down operations by operating the pump-down system to pump the pump-down fluid into the wellbore 102 to convey the perforating tool 234 through the wellbore 102 (block 806). In addition, the method 800 includes, after the pump-down fluid is pumped into the wellbore 102 and the perforating tool 234 is retrieved from the wellbore 102, operating the fluid valve system to fluidly disconnect (e.g., by closing a valve) the pump-down system from the wellbore 102 (block 808), operating the fluid valve system to fluidly connect (e.g., by opening a valve) the treatment fluid system to the wellbore 102 (block 810), and performing well treatment operations by operating the treatment fluid system to pump the treatment fluid into the wellbore 102 (block 812).

Figure 9:
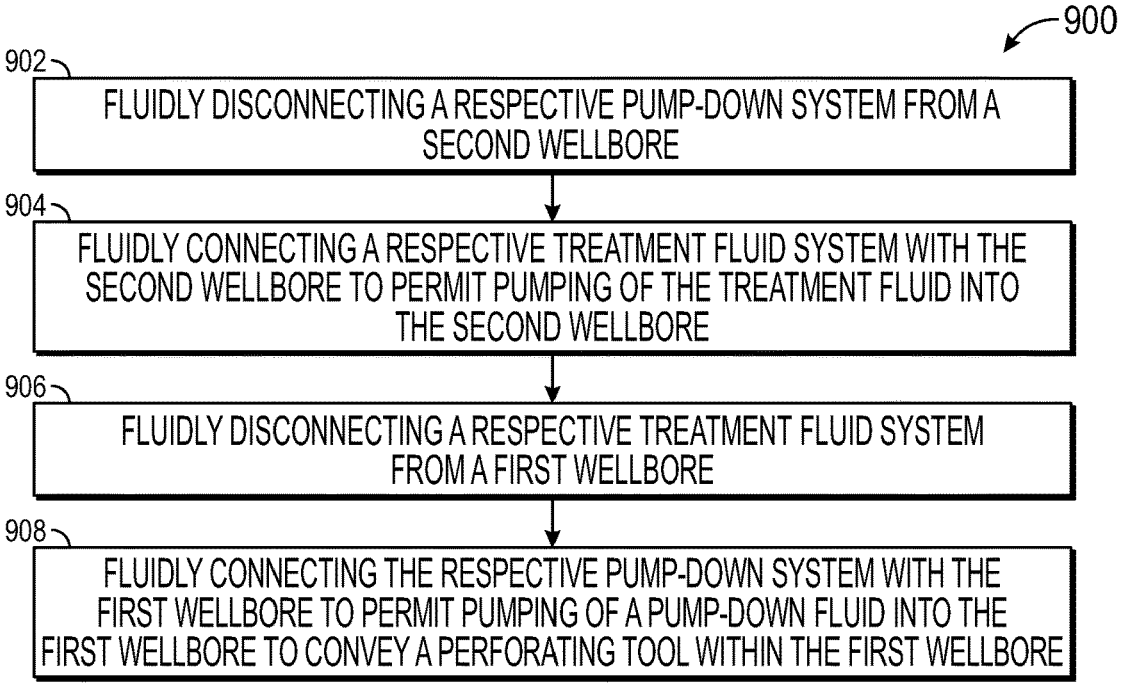
FIG. 9 is a block diagram of a method for coordinate pumping operations of a plurality of wellbores, in accordance with embodiments of the present disclosure.

In certain embodiments, a plurality of wellbores 102 may be monitored and controlled. FIG. 9 is a block diagram of a method 900 for coordinate pumping operations of a plurality of wellbores 102, in accordance with embodiments of the present disclosure. In certain embodiments, the method 900 may be performed by a controller 161, 212, 252, 262, 272, 312, 410 (e.g., as illustrated in FIGS. 1-4, and generally having at least the components described with respect to the processing device 500 illustrated in FIG. 5) configured to: (A) monitor operational status of a plurality of treatment fluid systems, as described in greater detail herein, configured to pump a treatment fluid into each of a plurality of wellbores 102 extending into a subterranean formation 106 from a surface of an oil and gas wellsite 104, a plurality of pump-down systems, as described in greater detail herein, configured to pump a pump-down fluid into a respective wellbore 102 to convey a perforating tool 234 within the respective wellbore 102, and a plurality of fluid valve systems, as described in greater detail herein, configured to selectively fluidly connect and disconnect the respective treatment fluid system and pump-down system to and from the respective wellbore 102; and (B) control operations of the treatment fluid systems, the pump-down systems, and the fluid valve systems with respect to the wellbores 102. In particular, in certain embodiments, the controller may be configured to operate the fluid valve system to alternatingly connect and disconnect the treatment fluid system and the pump-down system to and from the respective wellbore 102. In certain embodiments, the treatment fluid may be or include a fracturing fluid, and the treatment fluid systems may be or include a fracturing fluid mixing and pumping system for facilitating well fracturing operations.

For example, as illustrated in FIG. 9, in certain embodiments, the method 900 includes operating the fluid valve system to simultaneously: fluidly disconnect the respective pump-down system from a second wellbore 102 (block 902), fluidly connect the respective treatment fluid system to the second wellbore 102 to permit pumping of the treatment fluid into the second wellbore 102 (block 904), fluidly disconnect the respective treatment fluid system from a first wellbore 102 (block 906), and fluidly connect the respective pump-down system to the first wellbore 102 to permit pumping of the pump-down fluid into the first wellbore 102 to convey the perforating tool 234 within the first wellbore 102 (block 908).

The specific embodiments described herein have been illustrated by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

The invention claimed is:

1. A system, comprising:

a fluid valve system configured to selectively fluidly connect, disconnect, and distribute a fluid from one or more surface fluid delivery systems to and from a plurality of wellbores extending into a subterranean formation from a surface of an oil and gas wellsite; and a controller comprising at least one processor and at least one memory storing processor-executable instructions, wherein the controller is communicatively connected to the fluid valve system and the one or more surface fluid delivery systems, and wherein the processor-executable instructions, when executed by the at least one processor, cause the controller to:

monitor operational statuses of the fluid valve system and the one or more surface fluid delivery systems; and control operations of the fluid valve system based at least in part on the operational statuses of the fluid valve system and the one or more surface fluid delivery systems.

2. The system of claim 1, wherein the fluid valve system comprises:

a first fluid control valve fluidly connected between a first surface fluid delivery system of the one or more surface fluid delivery systems and the wellbore, wherein the first fluid control valve is configured to selectively fluidly connect and disconnect the first surface fluid delivery system to and from the wellbore, and wherein the first fluid control valve is connected to a wellhead associated with the wellbore; and a second fluid control valve fluidly connected between a second surface fluid delivery system of the one or more surface fluid delivery systems and the wellbore, wherein the second fluid control valve is configured to selectively fluidly connect and disconnect the second surface fluid delivery system to and from the wellbore, and wherein the second fluid control valve is connected to the wellhead.

3. The system of claim 2, wherein the fluid valve system comprises one or more interlock valves configured to isolate the first and second surface fluid delivery systems from each other when swapping between the first and second surface fluid delivery systems being fluidly connected and disconnected to and from the wellbore.

4. The system of claim 1, wherein the processor-executable instructions, when executed by the at least one processor, cause the controller to operate the fluid valve system to alternatingly connect and disconnect a treatment fluid system and a pump-down system of the one or more surface fluid delivery systems to and from the wellbore.

5. The system of claim 4, wherein the processor-executable instructions, when executed by the at least one processor, cause the controller to operate the fluid valve system to:

open a first valve of the fluid valve system to fluidly connect the treatment fluid system to the wellbore during well treatment operations performed by the treatment fluid system;

close a second valve of the fluid valve system to fluidly disconnect the pump-down system from the wellbore during the well treatment operations performed by the treatment fluid system;

open the second valve of the fluid valve system to fluidly connect the pump-down system to the wellbore during pump-down operations performed by the pump-down system; and close the first valve of the fluid valve system to fluidly disconnect the treatment fluid system from the wellbore during the pump-down operations performed by the pump-down system.

6. The system of claim 4, wherein the processor-executable instructions, when executed by the at least one processor, cause the controller to:

after treatment fluid is pumped into the wellbore from the treatment fluid system:

operate the fluid valve system to fluidly disconnect the treatment fluid system from the wellbore; and operate the fluid valve system to fluidly connect the pump-down system to the wellbore; and after pump-down fluid is pumped into the wellbore from the pump-down system and a perforating tool is retrieved from the wellbore:

operate the fluid valve system to fluidly disconnect the pump-down system from the wellbore; and operate the fluid valve system to fluidly connect the treatment fluid system to the wellbore.

7. The system of claim 1, and wherein the processor-executable instructions, when executed by the at least one processor, cause the controller to:

monitor operational statuses of the fluid valve system and the one or more surface fluid delivery systems with respect to each wellbore; and control operations of the fluid valve system with respect to each wellbore based at least in part on the operational statuses of the fluid valve system and the one or more surface fluid delivery systems, thereby facilitating distributed injection of a treatment fluid from the surface fluid delivery systems into the plurality of wellbores.

8. The system of claim 1, wherein the operational statuses of the fluid valve system comprise valve positions of valves of the fluid valve system that are monitored by the controller in substantially real time.

9. The system of claim 1, wherein the controller is configured to remotely control the operations of the fluid valve system.

10. A method, comprising:

monitoring, using a controller, operational statuses of a fluid valve system and one or more surface fluid delivery systems; and controlling, using the controller, operations of the fluid valve system to selectively fluidly connect, disconnect, and distribute fluid from the one or more surface fluid delivery systems to and from a plurality of wellbores extending into a subterranean formation from a surface of an oil and gas wellsite based at least in part on the operational statuses of the fluid valve system and the one or more surface fluid delivery systems.

11. The method of claim 10, comprising:

operating a first fluid control valve of the fluid valve system to selectively fluidly connect and disconnect a first surface fluid delivery system of the one or more surface fluid delivery systems to and from the wellbore, wherein the first fluid control valve is connected to a wellhead associated with the wellbore; and operating a second fluid control valve of the fluid valve system to selectively fluidly connect and disconnect a first surface fluid delivery system of the one or more surface fluid delivery systems to and from the wellbore, wherein the second fluid control valve is connected to the wellhead.

12. The method of claim 10, comprising operating, using the controller, the fluid valve system to alternatingly connect and disconnect a treatment fluid system and a pump-down system of the one or more surface fluid delivery systems to and from the wellbore.

13. The method of claim 12, comprising:

opening, using the controller, a first valve of the fluid valve system to fluidly connect the treatment fluid system to the wellbore during well treatment operations performed by the treatment fluid system;

closing, using the controller, a second valve of the fluid valve system to fluidly disconnect the pump-down system from the wellbore during the well treatment operations performed by the treatment fluid system;

opening, using the controller, the second valve of the fluid valve system to fluidly connect the pump-down system to the wellbore during pump-down operations performed by the pump-down system; and closing, using the controller, the first valve of the fluid valve system to fluidly disconnect the treatment fluid system from the wellbore during the pump-down operations performed by the pump-down system.

14. The method of claim 12, comprising:

after treatment fluid is pumped into the wellbore from the treatment fluid system:

operating, using the controller, the fluid valve system to fluidly disconnect the treatment fluid system from the wellbore; and operating, using the controller, the fluid valve system to fluidly connect the pump-down system to the wellbore; and after pump-down fluid is pumped into the wellbore from the pump-down system and a perforating tool is retrieved from the wellbore:

operating, using the controller, the fluid valve system to fluidly disconnect the pump-down system from the wellbore; and operating, using the controller, the fluid valve system to fluidly connect the treatment fluid system to the wellbore.

15. The method of claim 10, wherein the wellbore is one of a plurality of wellbores, and wherein the method comprises:

monitoring, using the controller, operational statuses of the fluid valve system and the one or more surface fluid delivery systems with respect to each wellbore; and controlling, using the controller, operations of the fluid valve system with respect to each wellbore based at least in part on the operational statuses of the fluid valve system and the one or more surface fluid delivery systems and thereby facilitating distributed injection of a treatment fluid from the surface fluid delivery systems into the plurality of wellbores.

16. The method of claim 10, wherein the operational statuses of the fluid valve system comprise valve positions of valves of the fluid valve system that are monitored by the controller in substantially real time.

17. The method of claim 10, comprising remotely controlling, via the controller, the operations of the fluid valve system.

18. A surface fluid valve control system, comprising:

a controller comprising at least one processor and at least one memory storing executable processor-executable instructions, wherein the controller is configured to be communicatively connected to a fluid valve system and one or more surface fluid delivery systems, and wherein the processor-executable instructions, when executed by the at least one processor, cause the controller to:

monitor operational statuses of the fluid valve system and the one or more surface fluid delivery systems; and control operations of the fluid valve system to selectively fluidly connect, disconnect, and distribute fluid from the one or more surface fluid delivery systems to and from a plurality of wellbores extending into a subterranean formation from a surface of an oil and gas wellsite based at least in part on the operational statuses of the fluid valve system and the one or more surface fluid delivery systems, thereby facilitating distributed injection of a treatment fluid from the surface fluid delivery systems into the plurality of wellbores.

19. The surface fluid valve control system of claim 18, wherein the operational statuses of the fluid valve system comprise valve positions of valves of the fluid valve system that are monitored by the controller in substantially real time.

20. The surface fluid valve control system of claim 18, wherein the controller is configured to remotely control the operations of the fluid valve system.

* * * * *